US007544878B2

(12) United States Patent
Mishima et al.

(10) Patent No.: US 7,544,878 B2
(45) Date of Patent: Jun. 9, 2009

(54) MUSICAL PERFORMANCE APPARATUS

(75) Inventors: Junichi Mishima, Iwata (JP); Tomonori Koizumi, Hamamatsu (JP); Liping Lu, Zhejiang (CN)

(73) Assignee: Yamaha Corporation, Hamamatsu-Shi (JP)

( * ) Notice: Subject to any disclaimer, the term of this patent is extended or adjusted under 35 U.S.C. 154(b) by 87 days.

(21) Appl. No.: 11/132,768

(22) Filed: May 18, 2005

(65) Prior Publication Data

US 2005/0257668 A1 Nov. 24, 2005

(30) Foreign Application Priority Data

May 21, 2004 (JP) ..... 2004-152627

(51) Int. Cl.
*A63J 5/10* (2006.01)
*A63J 17/00* (2006.01)
*G10H 1/00* (2006.01)

(52) U.S. Cl. ..... 84/464 R; 84/464 A; 84/477 R

(58) Field of Classification Search ..... None
See application file for complete search history.

(56) References Cited

U.S. PATENT DOCUMENTS 4,236,191 A * 11/1980 Martinez ..... 362/554
4,563,933 A * 1/1986 Kim ..... 84/267
5,796,025 A * 8/1998 Haake ..... 84/464 R
6,452,081 B1 * 9/2002 Ravagni et al. ..... 84/477 R
6,586,666 B2 * 7/2003 Abe ..... 84/477 R
6,759,582 B2 * 7/2004 Rouston ..... 84/421
7,019,206 B2 * 3/2006 Mishima ..... 84/723
2002/0062726 A1 * 5/2002 Abe ..... 84/464 A

FOREIGN PATENT DOCUMENTS

JP 61-76488 U 5/1986
JP 62-137093 8/1987
JP 2565850 9/1989
JP 02-168980 6/1990

(Continued)

OTHER PUBLICATIONS

Notification of Reasons(s) for Refusal (Office Action) for Japanese Patent Application No. 2004-152627, mailed Jul. 8, 2008.

(Continued)

*Primary Examiner*—Marlon T Fletcher
(74) *Attorney, Agent, or Firm*—Morrison & Foerster LLP

(57) ABSTRACT

In an electronic keyboard instrument (1) being an example of a musical performance apparatus having a musical operation unit, a unique musical performance apparatus is formed by an outer face of its exterior (2), and part or a whole of the outer face of the exterior (2) is formed as a temperature sensitive discolorable layer, for example, as shown by the hatched outer faces of upper side panels (22), lower side panels (23), and a back panel (25), so that at least part of the exterior (2) changes in color according to a change in environmental temperature or a temperature change caused by radiant heat by illumination of lights (34). In order to forcibly discolor the temperature sensitive discolorable layer of the exterior (2), it is preferable that heaters or Peltier modules are incorporated in the exterior (2) and electricity is supplied thereto for enabling heating, or heating and cooling.

21 Claims, 12 Drawing Sheets

FOREIGN PATENT DOCUMENTS

| | | | |
|---|---|---|---|
| JP | H4-22996 | | 2/1992 |
| JP | 07-201462 | | 8/1995 |
| JP | 10-097247 | | 4/1998 |
| JP | 10-124078 | | 5/1998 |
| JP | 3235856 | B2 | 5/1998 |
| JP | 2000-250535 | A | 9/2000 |
| JP | 2002-064603 | | 2/2002 |

OTHER PUBLICATIONS

Decision of Refusal for Japanese Patent Application No. 2004-152627, mailed Oct. 7, 2008; (2 pp Japanese text and 2 pp English translation).

* cited by examiner

FIG. 19

| NO. K | CHORD TYPE CT[K] | DETECTION RULE CPTN [K] | REFERENCE PATTERN |
|---|---|---|---|
| 0 | M | 1−3−5 | Major |
| 1 | m | 1−b3−5 | minor |
| 2 | 7 | 1−3−(5)−b7 | 7th |
| 3 | m7 | 1−b3−(5)−b7 | minor |
| 4 | M7 | 1−3−(5)−7 | Major |
| 5 | m7−5 | 1−b3−b5−b7 | minor |
| 6 | 7sus4 | 1−4−5−b7 | 7th |
| 7 | AUG | 1−3−#5 | Major |
| 8 | dim | 1−b3−b5 | Major |
| 9 | mM7 | 1−b3−(5)−7 | minor |
| 10 | 6 | 1−3−5−6 | Major |
| 11 | m6 | 1−b3−5−6 | minor |
| 12 | 7−5 | 1−3−b5−b7 | 7th |
| 13 | SUS4 | 1−4−5 | Major |
| 14 | 7+5(AUG7) | 1−3−#5−b7 | 7th |
| 15 | Madd9 | 1−2−3−5 | Major |
| 16 | madd9 | 1−2−b3−5 | minor |
| 17 | 7(9) | 1−2−3−(5)−b7 | 7th |
| 18 | m7(9) | 1−2−b3−(5)−b7 | minor |
| 19 | M7(9) | 1−2−3−(5)−7 | Major |
| 20 | mM7(9) | 1−2−b3−(5)−7 | minor |
| 21 | 7(b9) | 1−b2−3−(5)−b7 | 7th |
| 22 | 7(13) | 1−3−(5)−6−b7 | 7th |
| 23 | 7(b13) | 1−3−5−b6−b7 | 7th |
| 24 | M7−5 | 1−3−b5−7 | Major |

MUSICAL PERFORMANCE APPARATUS

BACKGROUND OF THE INVENTION

1. Field of the Invention

The invention relates to a musical performance apparatus including: various acoustic musical instruments such as a keyboard instrument, for example, a piano and an organ, a stringed instrument, for example, a guitar and a cello, a brass instrument, for example, a trumpet and a trombone, a woodwind instrument, for example, a clarinet and a bassoon, and a percussion, for example, a timpani and a drum; various electric or electronic musical instruments such as an electronic organ, an electronic piano, an electric guitar, and a silent cello; and automatic musical performance apparatuses including a music box, and more particularly, the invention relates to a musical performance apparatus whose exterior (case) forming its outer shape has an outer face changeable in color.

2. Description of the Related Art

In traditional acoustic musical instruments such as a keyboard instrument, for example, a piano and an organ, and a stringed instrument, for example, a violins and a cellos, materials and colors of their exteriors as well as their outer shape and look are almost fixed.

Here, as disclosed in, for example, JU S61-76488 A, there has been proposed an electronic keyboard instrument structured such that surface panels different in color and pattern can be detachably attached to a desired face of its exterior (case).

In this electronic keyboard instrument, various kinds of surface panels can be attached to surfaces of a top panel, a front panel, side panes, and so on. The surface panel is made of synthetic resin, decorative sheet, plywood, or the like, and various patterns, pictures, and so on are printed on its surfaces, so that a user can select any of the surface panels that suits the user's taste, at the time of the purchase. Further, even after the purchase, the outer look of the musical instrument can be changed by replacing the surface panel according to a change of the interior of a room where the musical instrument is installed, seasons, and so on.

However, thus making the panel attachable/detachable to/from the outer face of the exterior poses restrictions on its structure and shape, and it is difficult to apply such a panel to a stringed instrument, a brass instrument, a woodwind instrument, a percussion, and the like having many curved faces. In addition, it has been difficult to fully satisfy demands that are different depending on users having different national characters, locality, sex, age, intended use, usage environment, and so on.

Further, it takes time and cost to replace the surface panel of the exterior of this electronic keyboard instrument. Moreover, even the genre of a played musical piece or a playing method is changed, the outer look of the musical instrument does not change and the way it looks to the audience does not change, which has not been very much attractive.

SUMMARY OF THE INVENTION

The invention was made in consideration of such circumstances, and its object is to make an outer look easily changeable in color according to a user's taste, an installation environment, intended use, and so on, in any musical performance apparatus including various kinds of musical instruments and automatic musical performance apparatuses such as a music box.

Another object is to make an outer face of a musical performance apparatus itself changeable in color according to the kind and contents of a played musical piece or according to the mode of the musical performance, thereby attracting more interest of a player and those who appreciate the musical performance and making the musical performance more entertaining.

In order to achieve the objects stated above, a musical performance apparatus according to the invention includes: a musical operation unit; and an exterior forming, by an outer face thereof, an outer shape of the unique musical performance apparatus (a musical instrument such as a piano, an electronic keyboard instrument, an electronic violin, an electronic guitar, and a trumpet, and an automatic musical performance apparatus, etc.), wherein part or a whole of the outer face of the exterior is formed as a temperature sensitive discolorable layer.

It is preferable to further provide a temperature controller forcibly discoloring the temperature sensitive discolorable layer of the exterior (for example, a device that illuminates the exterior with a light to raise the temperature, a device for heating that supplies electricity to electrically heated wires provided inside the exterior, or a device for heating or cooling by Peltier modules incorporated in the exterior).

Alternatively, part or a whole of the outer face of the exterior of the musical performance apparatus may be formed as a coloration layer, and the musical performance apparatus may include: a multicolored light emitting unit that is provided on an inner side of the coloration layer to emit light to the coloration layer; and a controller that controls color of the light emitted by the multicolored light emitting unit to thereby set color of the part or the whole of the outer face of the exterior to one color or a plurality of colors among the colors of the emitted light.

Further, such a structure is also possible that a musical sound control parameter generator generating a musical sound control parameter is provided, and the aforesaid controller is a parameter responding discoloration controller that controls the color of the part or the whole of the outer face of the exterior in response to the musical sound control parameter generated by the musical sound control parameter generator.

In this case, the musical sound control parameter generated by the musical sound control parameter generator may be motif or tempo, and the parameter responding discoloration controller controls change of the color of the part or the whole of the outer face of the exterior according to the motif or the tempo.

Further, in these musical performance apparatuses, the controller may have a brightness controller that controls brightness of the color of the part or the whole of the outer face of the exterior according to the tempo of sound of musical performance.

The musical sound control parameter generator may generate the musical sound control parameter based on automatic musical performance data.

Alternatively, the musical sound control parameter generator may generate the musical sound control parameter according to progress of music of musical performance, or based on beat data or bar unit data of sound of musical performance.

Preferably, the parameter responding discoloration controller performs the control operation only at a predetermined beat of sound of musical performance.

Further, when the musical sound control parameter generator generates, as the musical sound control parameter, data indicating whether a played musical piece is in major or in minor, the parameter responding discoloration controller preferably controls the color of the part or the whole of the outer face of the exterior in response to the data indicating whether the played musical piece is in major or in minor, which is generated by the musical sound control parameter generator. Incidentally, when there is no data indicating major or minor, the control may be such that the color is set to color corresponding neither to the major nor to the minor, or to preset color.

The parameter responding discoloration controller preferably performs the control operation at a beginning of a phrase of sound of musical performance.

In a stringed instrument-type musical performance apparatus provided with operation elements for designating a sound producing timing, the apparatus may include: an exterior frame for shaping the musical performance apparatus, the exterior frame being made of a coloration member and forming at least part of an outline of the stringed instrument-type musical performance apparatus; and a controller that changes color appearance of part or a whole of the exterior frame.

In the musical performance apparatus according to this invention, the part or the whole of the outer face of the exterior is formed as the temperature sensitive discolorable layer, so that the color of the part or the whole of the outer face of the exterior automatically changes according to the temperature of an installation environment or temperature rise caused by illumination, or the like. Further, when the temperature controller forcibly discoloring the temperature sensitive discolorable layer is further provided, the use of the temperature controller makes it possible to artificially change the color of the part or the whole of the outer face of the exterior to thereby change the color of the outer look of the musical performance apparatus.

In the musical performance apparatus in which part or the whole of the outer face of the exterior is formed as the coloration layer and which includes: the multicolored light emitting unit on an inner side of the coloration layer; and the controller controlling the color of the light emitted by the multicolored light emitting unit, it is possible, by the controller controlling the color of the light emitted by the multicolored light emitting unit, to change the color of the part or the whole of the outer face of the exterior of the musical performance apparatus to any color (single color or a plurality of colors), and to variously change the color of the outer look of the musical performance apparatus manually, or automatically in response to change of an environmental change and mode of musical performance.

Further, when the musical sound control parameter generator generating the musical sound control parameter is provided and the controller is the parameter responding discoloration controller that controls the color of the part or the whole of the outer face of the exterior in response to the musical sound control parameter, it is possible to partly or entirely change the color of the exterior of the musical performance apparatus according to various musical sound control parameters. Therefore, it is possible to automatically change the color (not only the color but including brightness) of the part or the whole of the outer face of the exterior of the musical performance apparatus while it is played, according to, for example, the kind (genre) and contents of a played musical piece, and according to motif including whether it is in major or in minor, tempo, and the like. This can attract more interest of a player or those who appreciate the musical performance, making the musical performance more entertaining.

It is also possible to independently change brightness (lightness) of the outer face of the exterior of the musical performance apparatus according to the set tempo of sound of musical performance.

These controls of the color of the outer face of the exterior of the musical performance apparatus can be executed based on the progress of the music of the musical performance, or based on the beat data or the bar unit data (including "n" bar unit data) of sound of musical performance, only at a predetermined beat of sound of musical performance, or at the beginning of a phrase (a phrase consists of one bar or the plural bars) of sound of musical performance. Accordingly, the color change of the outer look takes place in good timing with the change of the sound of the musical performance by the musical performance apparatus, which can give both auditory and visual entertainment to those who appreciate the musical performance.

In the stringed instrument-type musical performance apparatus according to the invention, it is possible to cause the coloration of its characteristic exterior frame forming at least part of the outline of the apparatus and to further change the color appearance thereof.

The above and other objects, features and advantages of the invention will be apparent from the following detailed description which is to be read in conjunction with the accompanying drawings.

BRIEF DESCRIPTION OF THE DRAWINGS

FIG. 19 is a view showing an example of a chord table used for a judging process in the subroutine in FIG. 16 for discriminating a key based on a plurality of KCs in a pool.

DETAILED DESCRIPTION OF THE PREFERRED EMBODIMENTS

Hereinafter, preferred embodiments of the invention will be specificaly described with reference to the drawings.

First Embodiment

Figure 1:
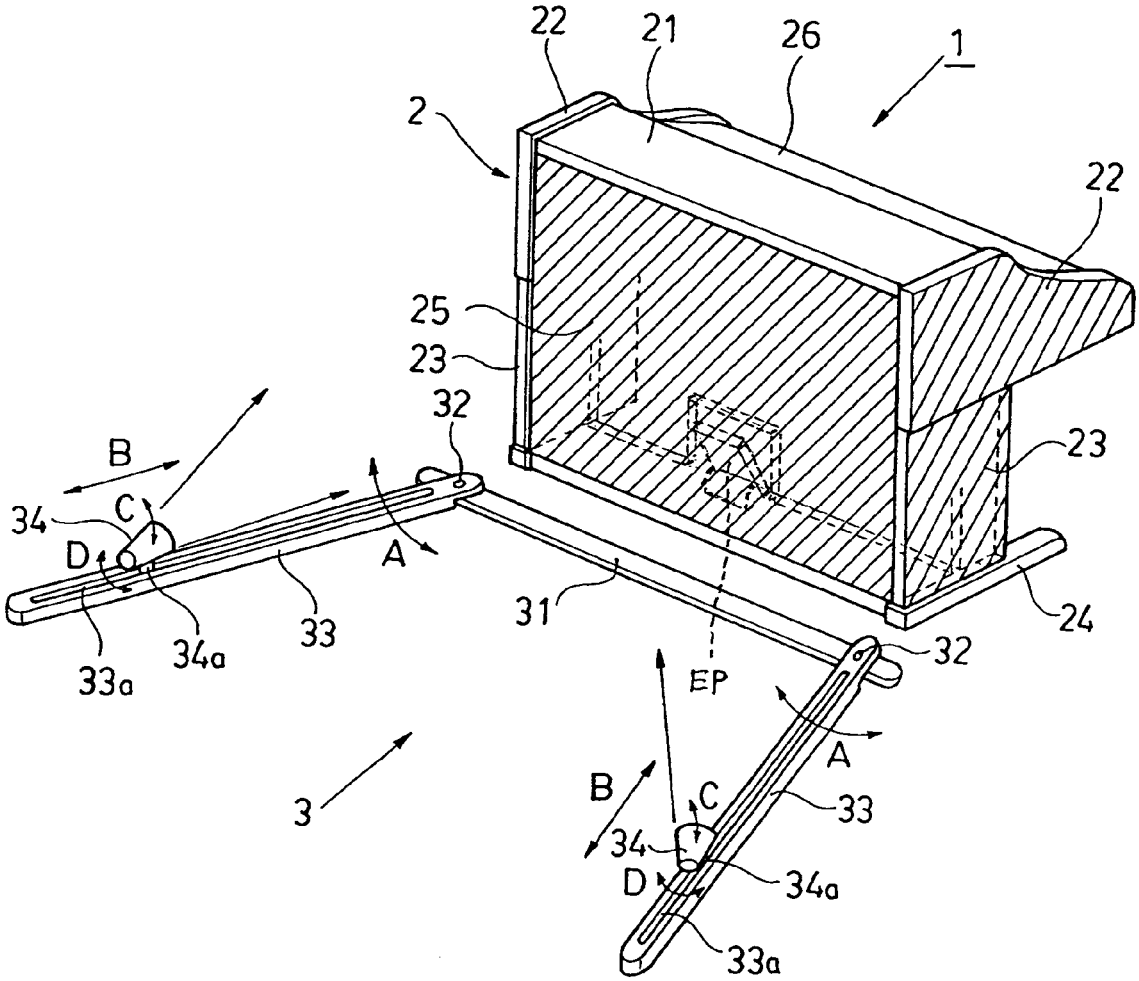
FIG. 1 is a perspective view showing an electronic keyboard instrument as a first embodiment of the musical performance apparatus according to the invention when it is seen obliquely from behind, with a lighting device being shown together.

To begin with, a first embodiment, which is the most fundamental embodiment of the musical performance apparatus according to the invention, will be described with reference to FIG. 1 and FIG. 2. FIG. 1 is a perspective view showing an electronic keyboard instrument such as an electronic organ or an electronic piano to which the invention is applied when it is seen obliquely from behind, with a lighting device being shown together, and FIG. 2 is an enlarged cross-sectional view of part of an exterior thereof.

Similarly to a typical electronic keyboard instrument such as an electronic organ, an exterior 2 (case in this embodiment) of this electronic keyboard instrument 1 includes a top panel 21, pairs of an upper side panel 22 and a lower side panel 23 provided on the right and left respectively, a base block 24, a back panel 25, and a keyboard cover 26, and further a front panel and a key slip, which are not shown, and so on. Outer faces of the exterior 2 including them form an outer shape of the electronic keyboard instrument 1 being a unique musical performance apparatus. In a lower part between the right and left upper side panels 22, provided is a not-shown key bed, on which a keyboard being a musical operation unit and an operation panel are disposed, and a keyboard cover 26 opens/closes an upper side of the keyboard and the operation panel.

Figure 2:
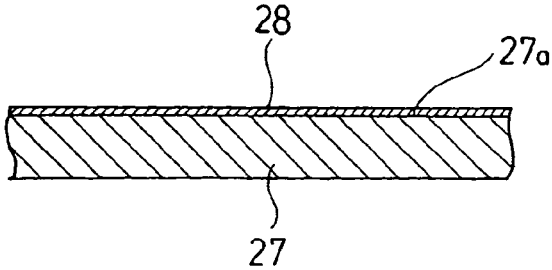
FIG. 2 is an enlarged cross-sectional view of part of an exterior of the electronic keyboard instrument shown in FIG. 1.

Further, as a structure unique to this embodiment, out of the respective parts forming the exterior 2, at least the back panel 25, the upper side panels 22, and the lower side panels 23 which are easily seen from the audience when the electronic keyboard instrument 1 is played on a stage have outer faces formed as temperature sensitive discolorable layers 28 as shown in FIG. 2. In FIG. 1, the outer faces formed as the temperature sensitive discolorable layers 28 are hatched.

FIG. 2 is an enlarged cross-sectional view of a portion of the exterior 2 whose outer surface is formed of the temperature sensitive discolorable layer, and this portion is formed such that the temperature sensitive discolorable layer 28 is formed on a smooth-finished outer surface 27*a* of a base panel 27 made of wood, plywood, or the like.

This temperature sensitive discolorable layer 28 is formed of a painted film made of a material whose color or transparency varies according to temperature or formed of a pasted film made of this material. For the temperature sensitive discolorable layer 28, used is a material that is in a transparency state at a certain temperature while being colored at other temperatures, or a material changing in color stepwise or non-stepwise according to temperature change. This will be described in detail later.

According to this embodiment, depending on the temperature of an environment where the electronic keyboard instrument 1 is installed, the temperature sensitive discolorable layer 28 formed on the surface of the exterior 2 changes in color or transparency (when transparency changes, the visible degree of the color of the base panel 27 changes). Therefore, the color of the outer faces of the back panel 25, the upper side panels 22, and the lower side panels 23 of the exterior 2 naturally changes, according to difference in atmospheric temperature depending on districts, or according to temperature difference or change due to seasonal change, day or night, indoor or outdoor, air-conditioned or not, illuminated or not, and the like.

Further, it is also possible to artificially change the color of the outer faces of the exterior 2 of the electronic keyboard instrument 1. For this purpose, the embodiment shown in FIG. 1 has a lighting unit 3 illuminating the exterior 2 obliquely from behind the electronic keyboard instrument 1.

This lighting unit 3 is composed of: a connecting member 31 extending along a lower portion of a back face of the electronic keyboard instrument 1; two support rails 33 which are pivotally supported by shafts 32 provided in both end portions of the connecting member 31 and which extend backward; and a pair of lights 34 with support portions 34*a* thereof supportedly fitted in guide grooves 33*a* formed in the support rails 33 respectively.

The support rails 33 are pivotable in an arrow A direction with respect to the connection member 31. The lights 34 are slidable in an arrow B direction along the guide grooves 33*a* of the support rails 33 and are also pivotable with respect to the support portions 34*a* in an arrow C direction (vertical adjustment of a radiation angle) and in an arrow D direction (horizontal adjustment of the radiation angle).

When the pair of lights 34 are lighted, it is possible to illuminate mainly the back panel 25, the upper side panels 22, and the lower side panels 23 of the exterior 2 obliquely from behind the electronic keyboard instrument 1. Radiant heat of the illumination causes temperature rise of the temperature sensitive discolorable layers 28 of the outer faces of the exterior 2, so that the temperature sensitive discolorable layers 28 can be forcibly discolored. As light sources of the lights 23, infrared lamps are preferably used.

Therefore, in this embodiment, a power supply circuit, switches, and the like, which are not shown, controlling the lighting unit 3 and the lighting of the lights 34 thereof correspond to a temperature controller forcibly discoloring the temperature sensitive discolorable layers 28.

Further, it is also possible to control the discoloration of the temperature sensitive discolorable layers 28 of the respective parts by changing the radiation angle or lightness of each of the lights 34 to control temperature distribution or a temperature rise ratio of the outer faces of the exterior 2. For example, it is also possible to change the color of the outer faces of the exterior 2 by changing the position, radiation angle, lightness, or the like of each of the lights 34 according to genre, motif, or the like of a played musical piece.

Incidentally, instead of or in addition to the temperature sensitive discolorable layer 28, interference pigment made of esterification cellulose ether (see, JP H9-508666 A), protean coat containing thermosetting resin (see JP H5-200980 A), or the like can be used to change the color depending on a light incident direction or depending on the viewing angle. In this case, instead of changing the radiation angles of light by the lights 34, the facing direction of the electronic keyboard instrument 1 may be changed. In this case, the angle from which the audience sees the musical instrument also changes.

In this embodiment, the outer faces of the exterior 2 of the electronic keyboard instrument 1 are partly formed as the temperature sensitive discolorable layers 28, but if the outer faces of the exterior 2 are entirely formed as the temperature sensitive discolorable layers, the whole surface of the exterior 2 changes in color according to the change in the environmental temperature, which is more preferably.

Second Embodiment

Figure 3:
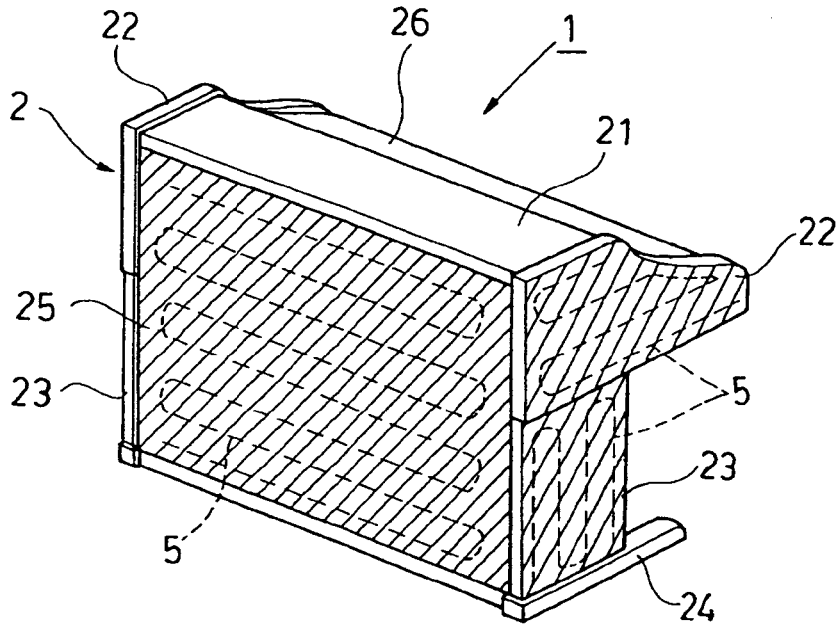
FIG. 3 is a perspective view showing an electronic keyboard instrument as a second embodiment of the musical performance apparatus according to the invention when it is seen obliquely from behind.

Next, a second embodiment of the musical performance apparatus according to the invention will be described with reference to FIG. 3. The second embodiment is also an electronic keyboard instrument similar to that of the first embodiment described above. FIG. 3 is a perspective view of the electronic keyboard instrument seen obliquely from behind. The same reference numerals are used to designate portions corresponding to those in FIG. 1, and detailed description thereof will be omitted.

Also in this embodiment, a back panel 25, upper side panels 22, lower side panels 23 forming an exterior 2 (case in this embodiment) of an electronic keyboard instrument 1 have outer faces formed of the same temperature sensitive discolorable layers as those of the first embodiment, and the outer faces formed of the temperature sensitive discolorable layers are also hatched in FIG. 3.

In each portion of the exterior 2 whose outer face is formed of the temperature discolorable layer, heater wires 5 being electrically heated wires run inside its base panel made of a wood plate, or, if the base panel is formed of a hollow plywood made of two bonded plates with a spacer therebetween, the heater wires 5 run in its hollow portion, as is shown by the broken lines in FIG. 3, so that the entire surfaces of the back panel 25, the upper side panels 22, and the lower side panels 23 can be heated. As the heater wire 5, a thin nichrome wire coated with a heat-resistant material, or the like is used.

According to this embodiment, it is possible to forcibly discolor the temperature sensitive discolorable layers without depending on the change in environmental temperature but by supplying electricity to the heater wires 5 to heat the base panels of the exterior 2.

Therefore, in this embodiment, the heater wires 5, and a power supply circuit, switches, and so on, which are not shown, for controlling the supply of electricity thereto correspond to a temperature controller forcibly discoloring the temperature sensitive discolorable layers.

It is also possible to control the color of the temperature sensitive discolorable layers by controlling the heating temperature through adjustment of an electric current amount supplied to the heater wires 5. Further, it is also possible to control portions of the exterior 2 to different colors by supplying different amounts of electric current to the respective heater wires 5 of the back panel 25, the upper side panels 22, and the lower side panels 23 and thus causing temperature difference thereamong.

According to this embodiment, it is possible to easily control the change of the color of the exterior 2 of the electronic keyboard instrument 1 according to genre, motif, or the like of a played musical piece.

Also in this embodiment, if the entire outer faces of the exterior 2 are formed as the temperature sensitive discolorable layers and the heater wires are disposed in the inner faces or the hollow portions of all the base panels, it is possible to variously change the colors of the whole surfaces of the exterior 2. In addition, it is also possible to depict pictures or characters by the heater wires and discolor only these portions.

Incidentally, the temperature of the outer faces of the exterior 2 cannot be lowered in this embodiment, but in cold districts or in winter season, its temperature controllable range is wide, so that the colors of the outer faces of the exterior 2 can be effectively changed.

Further, it is also possible to make characters and pictures eye-catching in such a manner that, as the heating elements, dotted heating elements instead of the heater wires are scattered inside the base panels of the exterior 2 whose outer faces are formed of the temperature sensitive discolorable layers, and electric current is supplied selectively to the heating elements, thereby partly discoloring the temperature sensitive discolorable layers of the outer faces of the exterior 2.

Third Embodiment

Figure 4:
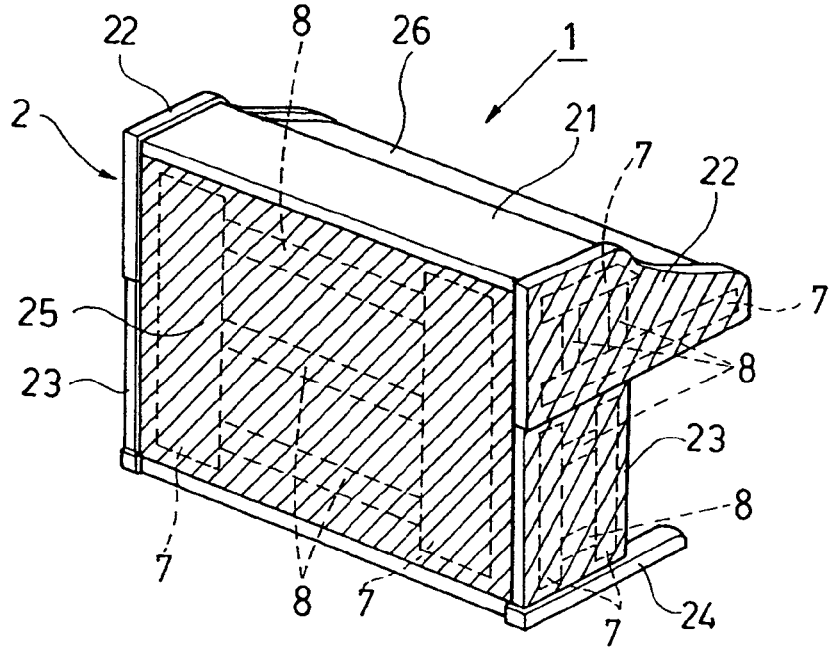
FIG. 4 is a perspective view showing an electronic keyboard instrument as a third embodiment of the musical performance apparatus according to the invention when it is seen obliquely from behind.
Figure 5:
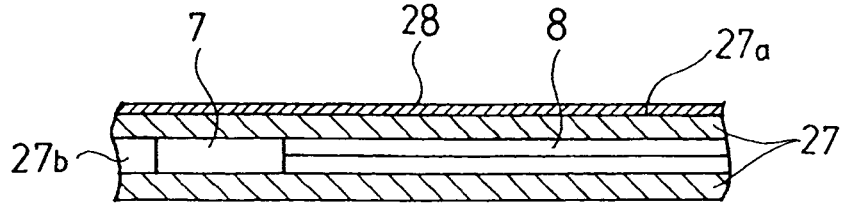
FIG. 5 is an enlarged cross-sectional view of part of an exterior of the electronic keyboard instrument shown in FIG. 4.

Next, a third embodiment of the musical performance apparatus according to the invention will be described with reference to FIG. 4 and FIG. 5. The third embodiment is also an electronic keyboard instrument similar to those of the first and second embodiments. FIG. 4 is a perspective view of the electronic keyboard instrument seen obliquely from behind, and FIG. 5 is an enlarged cross-sectional view of part of an exterior thereof. In these drawings, the same reference numerals are used to designate portions corresponding to those in FIG. 1 to FIG. 3, and description thereof will be omitted.

Also in this embodiment, a back panel 25, upper side panels 22, and lower side panels 23 forming an exterior 2 of the electronic keyboard instrument 1 have outer faces formed of the same temperature sensitive discolorable layers 28 as those of the first embodiment, and the outer faces formed of the temperature sensitive discolorable layers 28 are hatched also in FIG. 4.

As shown in FIG. 5, in each portion of the exterior 2 whose outer face is formed of the temperature sensitive discolorable layer 28, a base panel 27 is made of hollow plywood made of two bonded plates with a not-shown spacer therebetween, and a plurality of Peltier modules 7 and heat pipe panels 8 connecting therebetween are disposed in its hollow portion 27*b*. In FIG. 4, the Peltier modules 7 and the heat pipe panels 8 are shown by the broken lines. They are arranged so as to be able to heat or cool the entire surfaces of the back panel 26, the upper side panels 22, and the lower side panels 23 of the exterior 2 as uniformly as possible.

The Peltier module 7 is formed of a large number of modularized Peltier devices utilizing a Peltier effect that causes generation or absorption of heat by the passage of an electric current through a joint portion of metals of different kinds, and it is capable of heating or cooling an outer face 27*a* side of the base panel 27 depending on the flow direction of the electric current.

The heat pipe panel 8 is a heat pipe worked into a flat panel, the heat pipe sealingly containing liquid such as alcohol in its pressure-reduced pipe. The heat pipe panels 8 are provided in order to convey the heat generated or absorbed in the Peltier modules 7 to the entire surface on the outer face side 27*a* of the base panel 27.

Instead of the heat pipe panels 8, metal plates large in heat conductivity such as copper plates or aluminum plates may be disposed. Further, for the outer face 27*a* side of each of the base panels 27 in each portion of the exterior 2 whose outer face is formed of the temperature sensitive discolorable layer 28, synthetic resin plates or the like high in strength, even with a small thickness, and low in heat insulation are preferably used.

According to this embodiment, it is possible to control the temperature of each portion of the exterior 2 whose outer face is formed of the temperature sensitive discolorable layer 28, in a wide range by heating or cooling this portion. This makes it possible to variously change the color of the temperature sensitive discolorable layer 28, so that the color of the outer look of the electronic keyboard instrument 1 can be arbitrarily changed according to a user's taste and an installation environment or according to a played musical piece, targeted listeners, and so on.

Incidentally, in this embodiment, in the case of the control such that the outer face side of the external 2 is heated by the Peltier modules 7, an inner face side is cooled, so that a player feels cool rather than hot by the heat, which is advantageous in summer or the like. On the other hand, in the case of the control such that the outer face side of the exterior 2 is cooled, the inner face side is heated, so that the player feels warm rather than cold, which is advantageous in winter or the like.

Also in this embodiment, if the entire outer faces of the exterior 2 are formed as the temperature sensitive discolorable layers, and the Peltier modules 7 and the heat pipe panels 8 are disposed inside all the base panels thereof, it is possible to arbitrarily change the colors of the entire surfaces of the exterior 2.

Material of Temperature Sensitive Discolorable Layer

A material of the temperature sensitive discolorable layer 28 will be described here.

As the material of the temperature sensitive discolorable layer 28, usable is a reversible thermodiscolorable composition described in, for example, JP H10-146204 A, a reversible temperature sensitive discolorable display described in, for example, JP2000-221885 A, or the like.

For example, a reversible thermodiscolorable pigment in which a reversible thermodiscolorable material containing 3 parts of 1,2-benz-6-diethylaminofluoran, 5 parts of 4,4'-decylidene bisphenol, and 50 parts of stearyl caprate is enclosed with an epoxy resin coating discolors to pink and colorless with a hysteresis of about 7° C. substantially in a range from 27° C. to 38° C.

Further, a reversible thermodiscolorable pigment in which a reversible thermodiscolorable material containing 1 part of 3-(2-ethoxy-4-diethylaminophenyl)-3-(1-ethylindole-3-yl)-4-azaphthalide, 4 parts of bisphenol A, 25 parts of myristyl alcohol, and 25 parts of decyl myristate is enclosed with an epoxy resin coating discolors to blue and colorless with a hysteresis of about 4° C. substantially in a range from 13° C. to 22° C.

Since the temperature ranges in which these two kinds of reversible thermodiscolorable pigments discolor are different from each other, mixing them for use as materials of the temperature sensitive discolorable layer 28 makes it possible to discolor the temperature sensitive discolorable layer 28 to colorless (color of its base) through pink and blue by changing the temperature in a state of about 13° C. or lower to a state of about 38° C. or higher.

Thus using the combination of various kinds of reversible thermodiscolorable pigments different in the temperature range of discoloration makes it possible to obtain a temperature sensitive discolorable layer that changes to desired color such as orange, purple, black, and so on.

Fourth Embodiment

Next, a fourth embodiment of the musical performance apparatus according to the invention will be described with reference to FIG. 6. This fourth embodiment is also an electronic keyboard instrument similar to those of the first to third embodiments described above, and an outer face of its exterior forms an outer shape of the electronic keyboard instrument being a unique musical performance apparatus. However, the mechanism for changing color of the outer face of the exterior is completely different from that of the embodiments described above.

Figure 6:
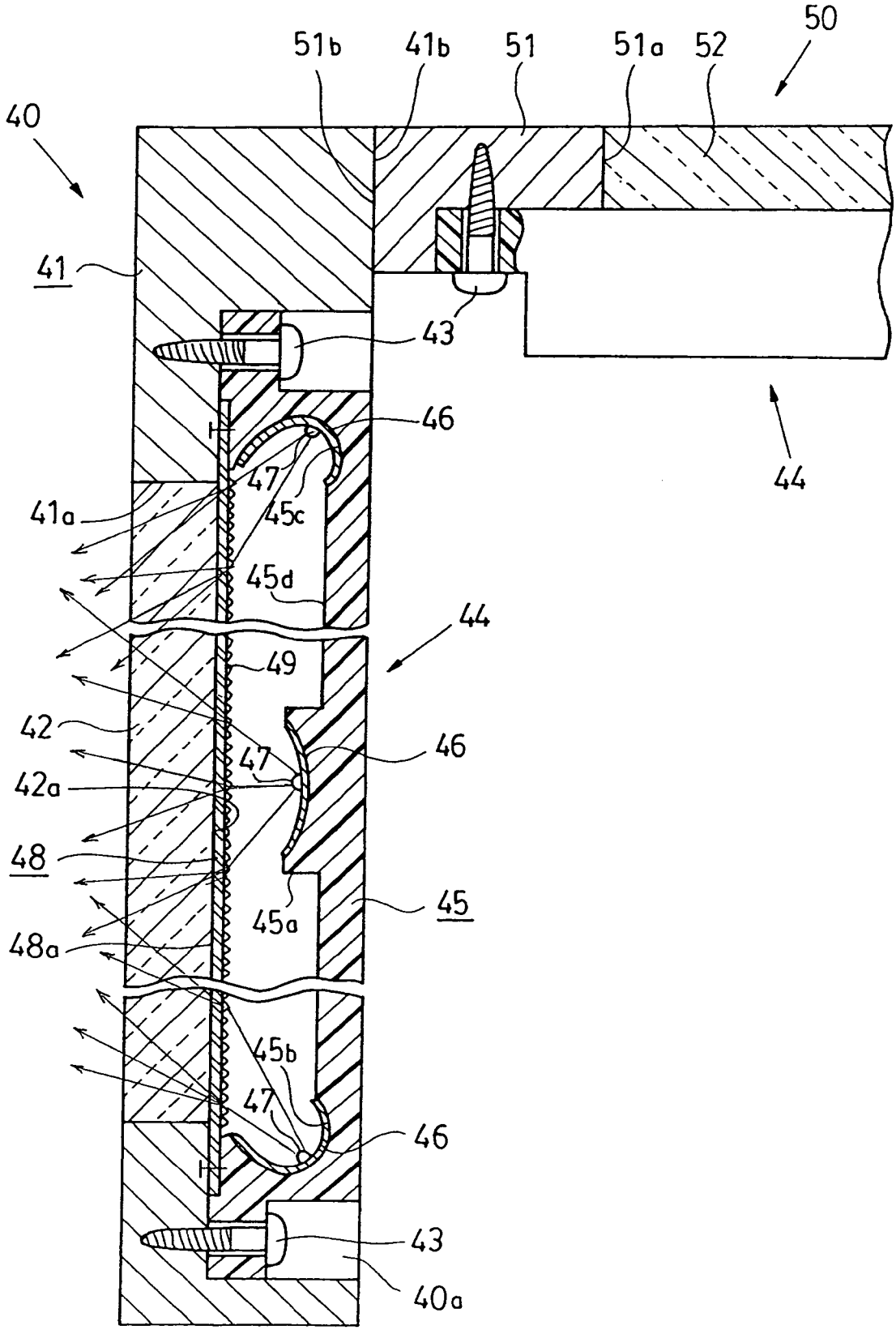
FIG. 6 is an enlarged horizontal cross-sectional view showing part of an exterior of an electronic keyboard instrument as a fourth embodiment of the musical performance apparatus according to the invention.

FIG. 6 is an enlarged horizontal cross-sectional view of part of a side panel unit and a back panel unit of the exterior, in which a side panel is cut at two places in a longitudinal direction of the drawing and reduced in size.

A side panel unit 40 forming the exterior of this electronic keyboard instrument corresponds to the upper side panel 22 and the lower side panel 23 in FIG. 1 and so on integrated together. The back panel unit 50 corresponds to the back panel 25 in FIG. 1 and so on.

The side panel unit 40 includes a side panel frame 41 made of an opaque material such as wood, a transparent face panel 42 (coloration layer) made of an acrylic plate fitted in a large window hole 41*a* of the side panel frame 41, and a light source unit 44 (multicolored light emitting unit) fixed with a screw 43 to a rear face side of the side panel frame 41 in which the face panel 42 is fitted.

The light source unit 44, as shown in FIG. 6, has a horizontal cross section in a channel shape with a flange, and includes a rear panel (serving also as an LED base) 45 extending in a perpendicular direction to the paper surface, that is, a height direction of the electronic keyboard instrument. The rear panel 45 has, in a widthwise center portion of its inner surface, an LED fixing portion 45*a* in a protruding ridge shape whose front face is a recessedly curved face, and the rear panel 45 also has, in both ends thereof, LED fixing portions 45*b*, 45*c* each having a recessedly curved face. Flexible substrates 46 are pasted on the three LED fixing portions 45*a* to 45*c*, being curved so as to match the curved faces of the LED fixing portions 45*a* to 45*c*, respectively. Each of the flexible substrates 46 has a multicolored light emitting diode (multicolored LED) 47 attached to its inner surface with a reflective layer formed thereon, The rear panel 45 is made of an opaque material such as wood or synthetic resin, and preferably, its channel-shaped inner face 45*d* except the portions on which the flexible substrates 46 are pasted is painted in highly reflective color such as white or silver.

The flexible substrate 46 uses a polymer material as its base, has the chip-shaped multicolored LED 47 attached on one face thereof (inner face of the curved flexible substrate) by soldering, and the reflective layer is formed on its surface by deposition or spray painting. In FIG. 6, it looks as if one LED is attached to each of the flexible substrates 46, but actually, each of the flexible substrates 46 extends long in the perpendicular direction to the paper surface and has a large number of the multicolored LEDs 47 attached at predetermined intervals.

A light scattering, transmissive material 48 in a sheet form is attached to the channel-shaped rear panel 45 to entirely cover an opening portion thereof. A large number of minute projections 49 are formed on an inner surface of the transparent sheet such as an acrylic plate of the light scattering, transmissive material 48. When the rear panel 45 is fixed to the side panel frame 41, an outer face 48*a* of the light scattering, transmissive material 48 comes in close contact with an inner face 42*a* of the transparent front panel 42.

Therefore, when the multicolored LEDs 47 of the light source unit 44 are lighted, beams by light emission thereof are reflected on the minute projections 49 of the light scattering, transmissive material 48, repeat diffused reflection in a space between the minute projections 49 and the inner surfaces of the flexible substrates 46 treated with reflectors or the inner face 45*d* of the rear panel 45, and are mixed in color and are diffused (scattered), so that the entire outer face 48*a* of the light scattering, transmissive material 48 emits light to the front panel 42 with uniform color and brightness.

Specifically, the use of the multicolored LEDs 47 having red and green light emitting elements can produce red light, green light, and yellow light produced by the light emission of the both elements. The use of the multicolored LEDs 47 each having red, green, and blue light emitting elements can produce red light, green light, and blue light by the light emission of the individual light emitting elements, yellow light by the light emission of the red and green elements, magenta light by the light emission of the red and blue elements, cyanic light by the light emission of the green and blue elements, and white light by the light emission of all the elements. Accordingly, the entire outer face 48*a* of the light scattering, transmissive material 48 also uniformly emits light in any of these colors. Adjusting the intensity of the emitted light of each of the light emitting elements forming the multicolored LEDs 47 makes it possible to obtain light emission in any neutral color.

The outer face 48*a* of the light scattering, transmissive material 48 also emits light with color and brightness according to the colors of the emitted lights of the multicolored LEDs 47. Accordingly, the transparent front panel 42 also comes to have color appearance with the same color and brightness, which is recognized as the color of the side panel by those who see it from the outside. If the front panel 42 is colored in milk-white or the surface thereof is frosted, the front panel 42 looks white while all the multicolored LEDs 47 are lighted out, and it looks soft in color while the multicolored LEDs 47 are lighted since their emitted lights scatter more uniformly.

Each of a large number of the minute projections 49 formed on the inner face of the light scattering, transmissive material 48 is 1 mm or less in height, and is in a circular cone shape or a pyramid shape with a triangle side section. However, the minute projections 49 provided in the vicinity of the widthwise center portion of the light scattering, transmissive material 48 and those in the vicinity of both ends thereof are different in shape. Specifically, the minute projections 49 in the vicinity of the widthwise (up/down direction in FIG. 6) center portion are pyramids whose generatrices are all equal in length on the entire circumference. On the other hand, the minute projections 49 in the vicinity of the both ends are pyramids whose generatrices on a side facing the center are longer than the generatrices on a side facing the end portion, and those near one end and those near the other end have shapes symmetrical with respect to the center. The minute projections 49 in between are in an intermediate shape between the shape of the minute projections 49 in the center portion and the shape of those in the both end portions, and difference in length of the generatrices on the entire circumference becomes smaller in the minute projections 49 closer to the center portion.

The thin arrows in FIG. 6 show examples of how the beams emitted by the multicolored LEDs 47 are scattered by the minute projections 49 to transmit through the light scattering, transmissive material 48. Thus varying the shape of a large number of the minute projections 49 of the light scattering, transmissive material 48 depending on the distance from the widthwise center portion makes it possible to promote diffusion and mixture of the beams emitted by the multicolored LEDs 47, thereby enhancing utilization efficiency thereof, and to make the light scattering, transmissive material 48 emit light brightly in more uniform color.

Further, instead of causing all the multicolored LEDs 47 of the light source unit 44 to emit lights in the same color, it is also possible to make part thereof emit light in different color. Accordingly, the light scattering, transmissive material 48 also partially emits light in different colors, so that the front panel 42 comes to have the color appearance in different colors depending on its areas, which gives the side panel an appearance with multicolored patterns full of variety.

The back panel unit 50, similarly to the side panel unit 40, also includes: a back panel frame 51 made of an opaque material; a transparent face panel 52 made of an acrylic plate or the like fitted in a large window hole 51*a* of the back panel frame 51; and a light source unit 44 fixed with a screw 43 to a rear face side of the back panel frame 51 in which the face panel 52 is fitted. The structure of the light source unit 44 is the same as that of the light source unit 44 of the side panel unit 40. Therefore, its cross section is not shown and description thereof will be also omitted.

The side panel unit 40 and the back panel unit 50 are fixed to each other by gluing or with a not shown screw in such a manner that, as shown in FIG. 6, a side face 51*b* at one side end of the back panel frame 51 is brought into contact with a rear face 41*b* at a rear end portion of the side panel frame 41. The back panel unit 50 and a side panel frame on the other side are fixed to each other in such a manner that a rear face at a rear end portion of the side panel frame on the other side is brought into contact with a not-shown side face at the opposite end portion of the back panel unit 50.

As is clear from the foregoing description, in this embodiment, the transparent face panels 42, 52 of the side panel unit 40 and the back panel unit 50 correspond to part or the whole of the outer face (most part of the outer faces of the side panel and the back panel in this example) of the exterior of the musical performance apparatus (electronic keyboard instrument in this example) that is formed as the coloration layer, and the light source units 44 correspond to the multicolored light emitting unit that is provided on an inner side of the coloration layer to emit light to the coloration layer.

By controlling the colors of the emitted lights of the multicolored light emitting units, the colors of the outer faces of the face panels 42, 52 of the side panel unit 40 and the back panel unit 50 forming the exterior can be set to any one color or a plurality of colors among the colors of the emitted lights. A controller for this purpose will be described later.

According to the fourth embodiment, the colors of the outer faces of the exterior of the electronic keyboard instrument can be arbitrarily changed not depending on temperature change, and the kinds of the colors thereof can be arbitrarily selected and electrically controlled with ease, so that it is also possible to dynamically change the color of the exterior according to a played musical piece or the mode of musical performance while the electronic keyboard instrument is being played.

Incidentally, it is also possible to change the colors of outer faces of other portions forming the exterior of this electronic keyboard instrument, that is, a top panel, a front panel, a key slip, and so on, by structuring them in the same manner as the side panel unit described above.

Fifth Embodiment

Next, a fifth embodiment of the musical performance apparatus according to the invention will be described with reference to FIG. 7. In the fifth embodiment, the invention is applied to a desktop electronic keyboard instrument.

In this desktop electronic keyboard instrument 60, its case 61 is an exterior, and an outer face thereof forms an outer shape of a unique musical performance apparatus. A keyboard unit 62 being a musical operation unit is provided in front of the case 61, and an operation panel 63 is disposed slantwise at the back thereof.

On the operation panel 63, many button switches 64 for selecting various functions, tones, and so forth, and a liquid crystal display (LCD) 65 are provided. The LCD 65 displays the contents of various parameters including color choices when they are to be set. Also provided is a LED 65M that displays a set tempo by flashing light emission when a metronome function is activated. Further, a tempo dial 66 for tempo designation and an RGB dial 67 for designating the color of the outer face of the case 61 are also provided. A music stand board 68 is detachably attached on an upper portion of the case 61.

A storage device 69 such as a disk driving unit is provided on a right side of a keyboard unit 62. When a recording medium such as a flexible disk, an optical disk, or a memory card is inserted therein, data on musical sound that has been produced by musical performance can be stored in the storage medium or data for automatic musical performance can be read from the recording medium storing this data, thereby enabling automatic musical performance.

The outer face of the case 61 may be structured so as to be artificially changeable in color in such a manner that a temperature sensitive discolorable layer is formed on part or the whole of the outer face so as to cause color change according to atmospheric temperature, room temperature, radiant heat by illumination, or the like, or a temperature controller such as heater wires or Peltier modules is provided inside the case 61, as in the first to third embodiments previously described.

However, the structure similar to that of the fourth embodiment previously described is preferable in order to enable instantaneous change of the color of the outer faces of the case 61 to any color in response to an electrical signal.

Specifically, an upper face, both side faces, and a back face forming the case 61, and the outer faces of the operation panel 63 and the music stand board 68 are partly or entirely formed as coloration layers, a multicolored light emitting unit emitting light to the coloration layers is provided on an inner side thereof, and the color of emitted light of the multicolored light emitting unit is controlled, so that color of part or the whole of the outer faces of the case 61 can be set to any one color or a plurality of colors among the colors of the emitted lights. The coloration layer is made of transparent or translucent resin or the like. The multicolored light emitting unit includes a required number of multicolored LEDs, and also includes a light scattering, transmissive material that scatters lights emitted by the multicolored LEDs, a light guide through which the lights propagate, or the like.

With this structure, the coloration layers forming the outer faces of the case 61 and so on receive the color of the emitted light of the multicolored light emitting unit to have color appearance in the same color, so that part or the whole of the case 61 and so on can be changed to arbitrary color. Further, it is also possible to make portions of the case 61 and so on in different colors.

The color of the case 61 and so on can be of course changed by user's manual setting according to the user's taste, but it is also possible to dynamically change the color of the case 61 and so on by automatic discrimination of a control parameter, motif, or the like of musical sound of musical performance while the desktop electronic keyboard instrument 60 is being played. A controller for the multicolored light emitting unit for this purpose will be described later.

Sixth Embodiment

Next, a sixth embodiment of the musical performance apparatus according to the invention will be described with reference to FIG. 8. In the sixth embodiment, the invention is applied to an electronic trumpet.

This electronic trumpet 70 includes a body 71 in an elongated block shape, and has a musical sound producing part 72 in a flare tube portion, a mouthpiece 73 in a player's side end portion, three key switches 74 in a piston shape on an upper portion, and a liquid crystal display (LCD) 75 for parameter display on a side face. Further, under the body 71, a grip portion 76 to be gripped by a hand, an operation panel 77 having many switches for tone selection and various parameter setting, and an operation element 78 for pitch bender are coupled by a coupling piece 79.

A small microphone is provided inside the mouthpiece 73, and an electronic circuit including a CPU, for producing musical sound and performing various controls is installed inside the body 71.

When this electronic trumpet 70 is played, a player grips the grip portion 76 by one hand and utters voice with the mouthpiece 73 in his/her mouth. Then, the built-in microphone converts the sound to an electrical signal, whose pitch and loudness are then detected by the electronic circuit. At this time, when the key switches 74 are operated by the other hand at the same time, a tone generating circuit generates a musical tone signal for the tone of the trumpet that is determined by the combination of the pitch and loudness of the voice from the mouthpiece 73 and on/off states of the three key switches 74, and this musical tone signal is processed according to various set parameters, is amplified by the musical sound producing part 72, and is converted to musical sound by a speaker to be outputted.

When the operation element 78 for pitch vender is slightly displaced with the finger inserted therein during musical performance, the pitch of musical sound can be slightly changed.

Therefore, in this electronic trumpet 70, the mouthpiece 73, the key switches 74, and the operation element 78 for pitch vender correspond to a musical operation unit, and the operation panel 77 forms the other various operation unit. Further, all of the body 71, the musical sound producing part 72, and the grip portion 76, the operation panel 77, and so on form the exterior, and outer faces thereof shape the electronic trumpet 70 that is a unique musical performance apparatus.

Outer faces of the exterior of the electronic trumpet 70, namely, the body 71 and so on, may be structured to be artificially changeable in color in such a manner that temperature sensitive discolorable layers are formed on part or the whole of the outer faces, or a temperature controller such as heater wires or Peltier modules is provided on an inner side thereof, as in the first to third embodiments previously described. However, the structure similar to that of the fourth embodiment previously described is preferable in order to enable instantaneous change of the color of the outer faces of the exterior to any color in response to an electrical signal.

For example, the outer faces of at least the body 71 and the grip portion 76, out of the aforesaid parts forming the exterior are partly or entirely formed as coloration layers, a multicolored light emitting unit emitting light to the coloration layers are provided on an inner side thereof, and the color of emitted light of the multicolored light emitting unit is controlled, so that the color of these outer faces can be set to any one color or a plurality of colors among the colors of the emitted lights. The coloration layer is made of transparent or translucent resin or the like. The multicolored light emitting unit includes a required number of multicolored LEDs and also includes a light scattering, transmissive material, which scatters lights emitted by the multicolored LEDs, a light guide through which the lights propagate, or the like.

With this structure, main parts of the exterior can be discolored to arbitrary color, so that the color of the exterior can be dynamically changed, as in the above-described fifth embodiment. A controller for the multicolored light emitting unit for this purpose will be described later.

Seventh Embodiment

Next, a seventh embodiment of the musical performance apparatus according to the invention will be described with reference to FIG. 9. In the seventh embodiment, the invention is applied to a stringed instrument-type musical performance apparatus, and the following will describe an example where the invention is applied to an electronic cello being a stringed instrument-type electronic musical instrument.

The stringed instrument-type electronic musical instrument is not necessarily required to have strings, but may be the one having a pseudo string unit. Later-described sensor wires and electrode pieces correspond to this pseudo string unit.

In this electronic cello 80, an elongated body 81, a neck 82 extending from an upper portion of the body 81 and provided with turning keys 83 at a tip thereof, a fingerboard 84 extending on the neck 82 to the body 81, three frames 85*a* to 85*c* in a curving line shape similar to the outline of a resonance body of an acoustic cello, and a metal stay 86 attached to a lower end of the body 81 form an exterior. Outer faces of these parts form an outer shape of the electronic cello 80 being a unique musical performance apparatus.

Here, the three frames 85*a* to 85*c* correspond to an exterior frame for shaping the musical performance apparatus, which is made of a coloration member and forms at least part of an outline (an outermost portion of the exterior) of the electronic cello 80 being the stringed instrument-type musical performance apparatus.

This electronic cello 80 has neither strings nor a bridge, but instead has, at a position on the body 81 corresponding to the bridge position in an acoustic cello, a sensor unit 88 provided with four short sensor wires 87 that are provided to be parallel to a longitudinal direction of the body 81, and on the fingerboard 84, many electrode pieces 89 are arranged in four arrays at positions corresponding to areas between frets of the strings.

When one of the four sensor wires 87 is played with a not-shown bow, the senor unit 88 discriminates the played sensor wire out of the sensor wires 87 and loudness thereof. When one of the electrode pieces 89 in an array corresponding to this sensor wire 87 is touched with a finger at the same time, an electronic circuit provided inside the body 81 and including a CPU detects the position thereof. Then, a tone generating circuit generates a musical tone signal for a tone of the cello with loudness according to the strength with which the sensor wire 87 is played, at a pitch corresponding to the combination of the sensor wire 87 and the electrode piece 89. The musical tone signal is outputted to a not-shown external sound system, is amplified there, and is converted to musical sound by a speaker to be outputted.

Therefore, in this electronic cello 80, the four sensor wires 87 and the many electrode pieces 89 form a musical operation unit corresponding to the pseudo string unit. Incidentally, in place of the electrode pieces 89, button switches may be provided for the respective areas between frets on the fingerboard 84.

As in the first to third embodiments described above, the body 81, the neck 82, the frames 85*a* to 85*c*, and so on forming the exterior of the electronic cello 80 may be structured such that part or the whole of outer faces thereof are formed as temperature sensitive discolorable layers to change in color according to atmospheric temperature, room temperature, radiant heat by illumination, or the like, or such that a temperature controller such as heater wires or Peltier modules is provided on an inner side thereof to enable artificial change of colors of the outer faces.

However, in this embodiment, the three frames 85*a* to 85*c* out of these parts forming the exterior are formed of light guides such as optical fibers. Each of the light guides has a cross section in a semicircular, square, or rectangular shape, and a front face ff being one of the faces thereof has "a rough surface", and the other faces have clear surfaces (mirror surfaces). When multicolored LEDs 8L1 to 8L6, which are provided on corresponding both end surfaces on the body 81 side respectively, emit lights to centers of the frames 85*a* to 85*c* formed of the light guides, the lights are diffused little by little by the "rough surfaces", so that the front faces ff (the front side faces as the light guides) emit lights. Consequently, the frames 85*a* to 85*c* come to have color appearance in one color or a plurality of colors among colors of the emitted lights of the multicolored LEDs 8L1 to 8L6.

Therefore, in this embodiment, the frames 85*a* to 85*c* being the exterior frames for shaping an outermost portion, which is the most conspicuous in the exterior of the electronic cello 80, are formed as the coloration members, and they can be instantaneously discolored to any color in response to an electrical signal.

The colors of the frames 85*a* to 85*c* can be of course changed manually by the operation of a color selection dial, switch, or the like provided on a rear face of the body 81, but can be dynamically changed while the electronic cello 80 is being played, similarly to the embodiments described above. If the other portions are structured in the same manner as in the above-described embodiments, their colors can be changed.

It should be noted that, even though the above-described embodiment has described the example where the invention is applied to the electronic cello, the invention is similarly applicable to any stringed instrument, that is, a violin, a viola, a contrabass, a guitar, a mandolin, and the like, and Chinese fiddles such as an erhu and a zhonghu as a hugin, a yuegin, a koto/thirteen strings, a samisen, a Japanese lute, and a sitar, or is applicable to musical performance apparatus such an electric or electronic musical instrument imitating these.

Structure Example of Electronic Circuit

Figure 10:
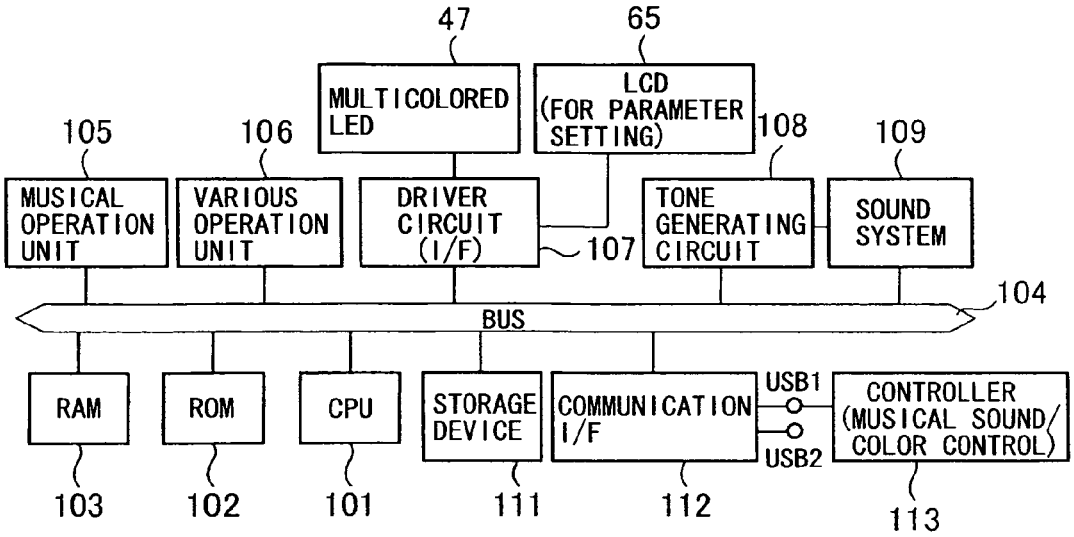
FIG. 10 is a block diagram showing an electronic circuit almost common to the fourth to seventh embodiments of the invention.

Next, a structure example of an electronic circuit almost common to the above-described fourth to eighth embodiments of the invention will be described. FIG. 10 is a block diagram of an electronic circuit in the electronic keyboard instrument and other electronic musical instruments.

In this electronic circuit, a CPU 101, a ROM 102, a RAM 103, and a bus 104 connecting them form a microcomputer, and the microcomputer (mainly the CPU 101) serves as a controller controlling all functions such as a musical performance function of a musical piece and the function of changing color of the exterior according to the invention.

A musical operation unit 105, other various operation unit 106, a driver circuit (also serving as an interface) 107 for driving lighting of a multicolored LED (including peripheral circuit) 47 of a light emitting unit that changes color of an exterior and for driving the data display of a liquid crystal display (LCD) 65 for parameter setting, a tone generating circuit 108 generating a musical tone signal with designated pitch and ton color, and a sound system 109 for amplifying the musical tone signal and adding various effects to the musical tone signal to convert it to musical sound for outputting are connected to the bus 104.

Further, when necessary, a storage device 111 such as a hard disk device, a flexible disk device, or a memory card device, and further a communication interface (I/F) 112 transmitting/receiving a musical sound control signal, a color control signal, and so on to/from an external controller 113 via a USB1 cable are also connected to the bus 104. It is also possible to control color of the own apparatus by an external control signal or control color of other musical instrument by generating a color control signal of the own apparatus, by using a USB2 pin.

Figure 7:
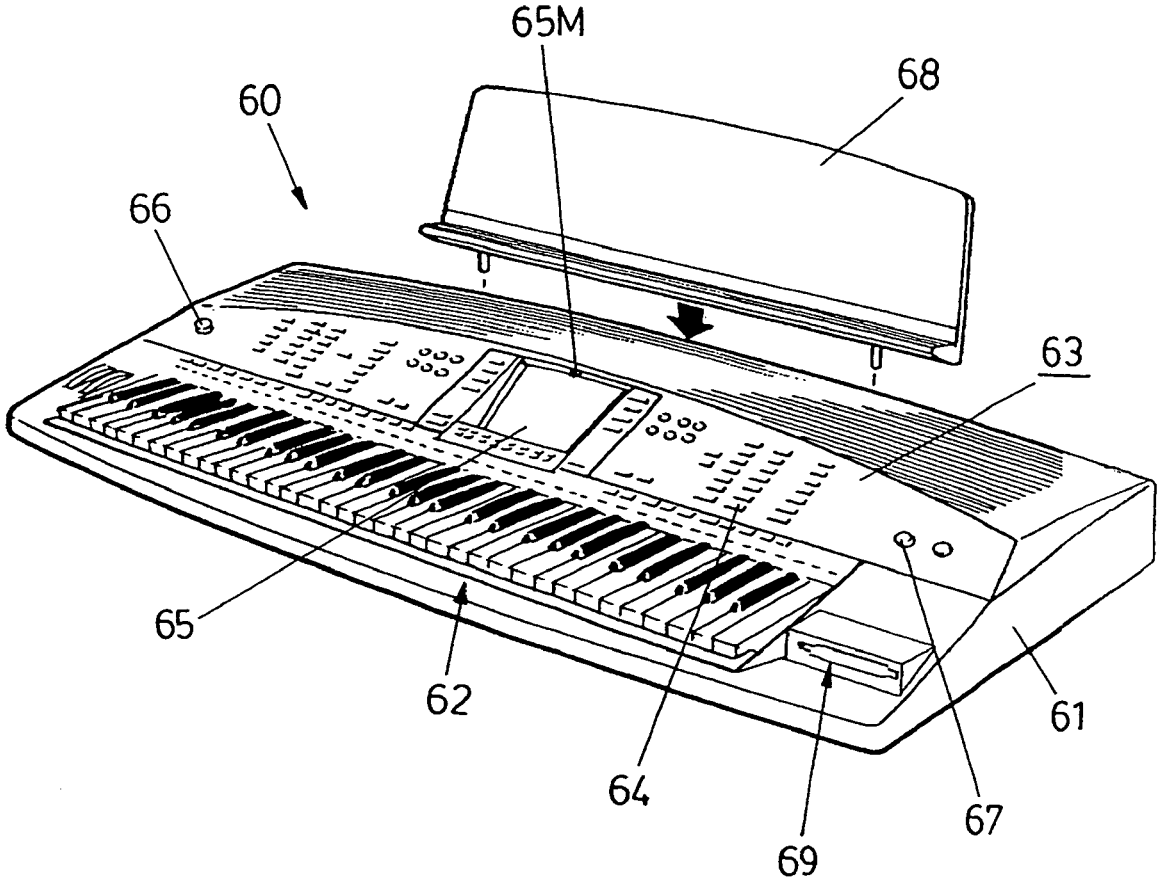
FIG. 7 is a perspective view showing a desktop electronic keyboard instrument as a fifth embodiment of the musical performance apparatus according to the invention.

In the fourth embodiment shown in FIG. 6, a keyboard, though not shown in FIG. 6, similar to a keyboard of a typical electronic organ or an electronic piano corresponds to the musical operation unit 105, and in the case of the desktop electronic keyboard instrument 60 of the fifth embodiment shown in FIG. 7, the keyboard unit 62 corresponds to the musical operation unit 105.

Figure 8:
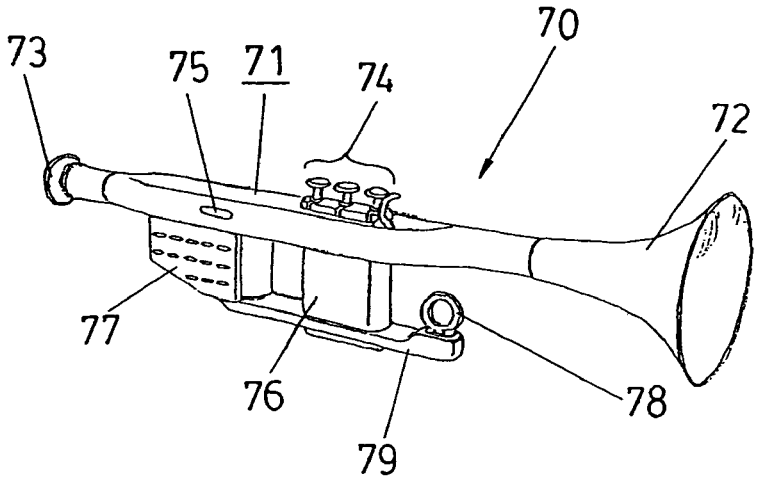
FIG. 8 is a perspective view showing an electronic trumpet as a sixth embodiment of the musical performance apparatus according to the invention.

In the case of the electronic trumpet 70 of the sixth embodiment shown in FIG. 8, the mouthpiece 73 having the built-in microphone, the key switches 74, and the operation element 78 for pitch bender correspond to this musical operation unit 105. In the case of the electronic cello 80 of the seventh embodiment shown in FIG. 9, the four sensor wires 87 and a large number of the electrode pieces 89 correspond to this musical operation unit 105.

In the fourth embodiment shown in FIG. 6, operation elements for setting tones, various effects, and so on, such as many switches and dials provided on an operation panel, though not shown in FIG. 6, which is similar to an operation panel of a typical electronic organ and electronic piano, correspond to the various operation unit 106. The various operation unit 106 also includes the operation element for setting the color of the exterior according to the invention.

In the case of the portable electronic keyboard instrument 60 of the fifth embodiment shown in FIG. 7, the many button switches 64, the tempo dial 66, and the RGB dial 67 for color setting, which are provided on the operation panel 63, correspond to the various operation unit 106.

In the case of the electronic trumpet 70 of the sixth embodiment shown in FIG. 8, various operation elements provided on the operation panel 77 correspond to the various operation unit 106, which includes the operation element for setting the color of the exterior according to the invention.

Figure 9:
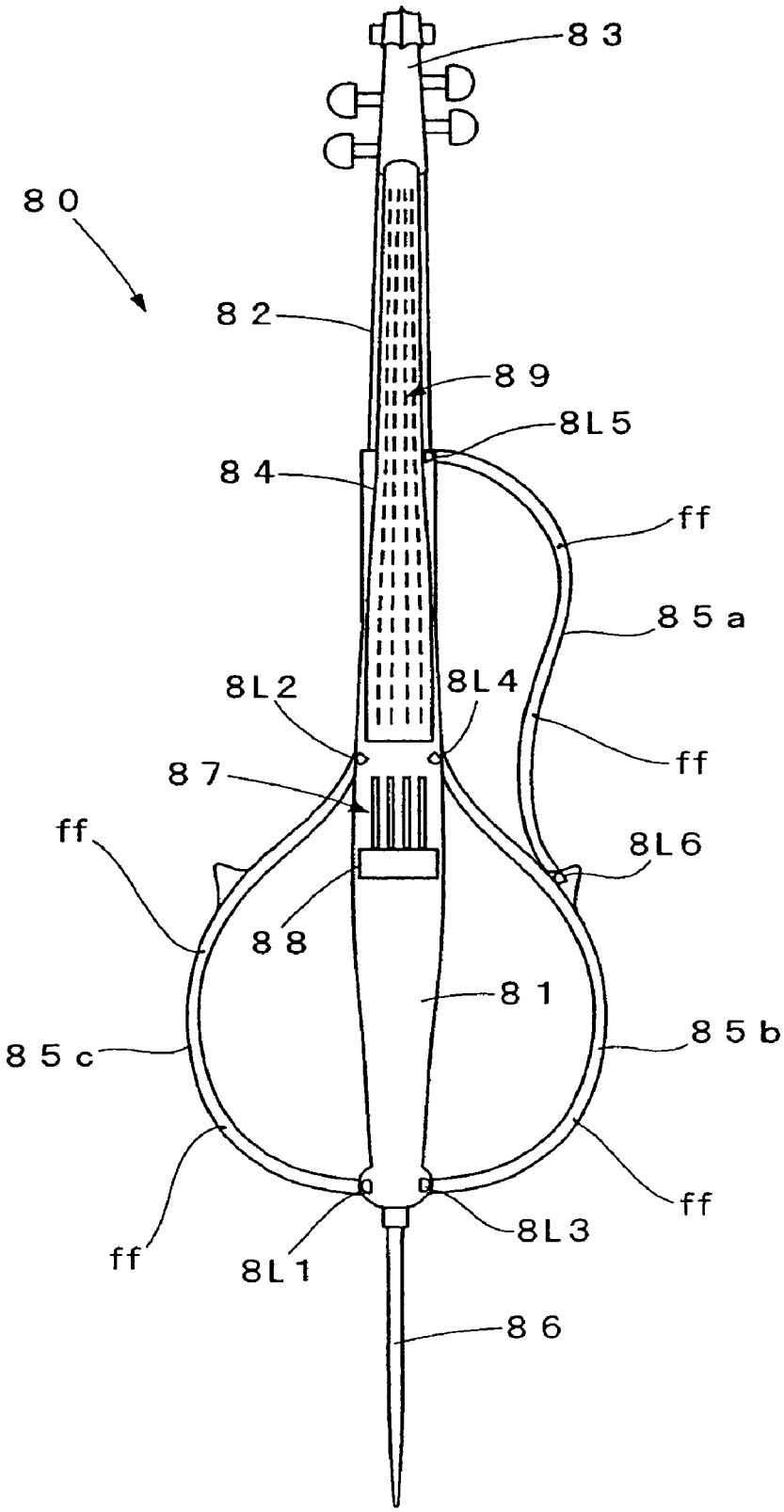
FIG. 9 is a front view showing an electronic cello as a seventh embodiment of the musical performance apparatus according to the invention.

In the case of the electronic cello 80 of the seventh embodiment shown in FIG. 9, a various operation element unit, though not shown, including operation elements for setting colors of the frames 85*a* to 85*c* are provided on a rear face side of the body.

Note that a controller for changing color appearance of these characteristic exterior frames is the aforesaid microcomputer including the CPU 101 and so on, and is realized by the microcomputer executing a subroutine of "automatic color control" at Step 15 in FIG. 14 or FIG. 17 to be described later, that is, executing control processes of steps shown in the flowchart in FIG. 16.

In case of these stringed instrument-type electronic musical instrument, the explanation of the process relating to the key event in the electronic keyboard instrument such as Step 7 and Step 8 being described later is changed to read the process relating to a plucking event and/or a string event.

The multicolored LED 47 corresponds to the multicolored LEDs 47 in the fourth embodiment shown in FIG. 6, and corresponds to the multicolored LEDs 8L1 to 8L6 in the seventh embodiment shown in FIG. 9, but the reference numeral 47 is used to represent all of them. Incidentally, a peripheral circuit for controlling lighting of each of the light emitting elements of the multicolored LED 47 is provided between the multicolored LED 47 and the driver circuit 107 or in one of them, and it will be described later.

In the fifth embodiment shown in FIG. 7, the LCD 65 for parameter setting corresponds to the LCD 65 displaying data for parameter setting and so on and the LED 65M for tempo display by the metronome function, which are provided on the operation panel 63, and in the six embodiment shown in FIG. 8, it corresponds to the LCD 75 provided on the side face of the body 71, but the reference numeral 65 is used to represent all of them.

The tone generating circuit 108 includes a waveform memory storing data that is a PCM coded waveform of a musical tone signal to be generated, a data read circuit for this data, a D/A converter converting the read digital data to an analog musical tone signal, and so on.

The sound system 109 may be provided in the musical instrument but if the space does not allow or if the musical instrument is played with a large volume, it may be separately prepared outside and a musical tone signal generated by the tone generating circuit 108 may be outputted thereto via a signal line.

The storage device 111 is used as an automatic musical performance memory for storing musical sound data on musical performance that has been executed and for reading and storing automatic musical performance data necessary for automatic musical performance to be executed. Further, it can also store musical sound control data and color control data received from the external controller 113.

Figure 11:
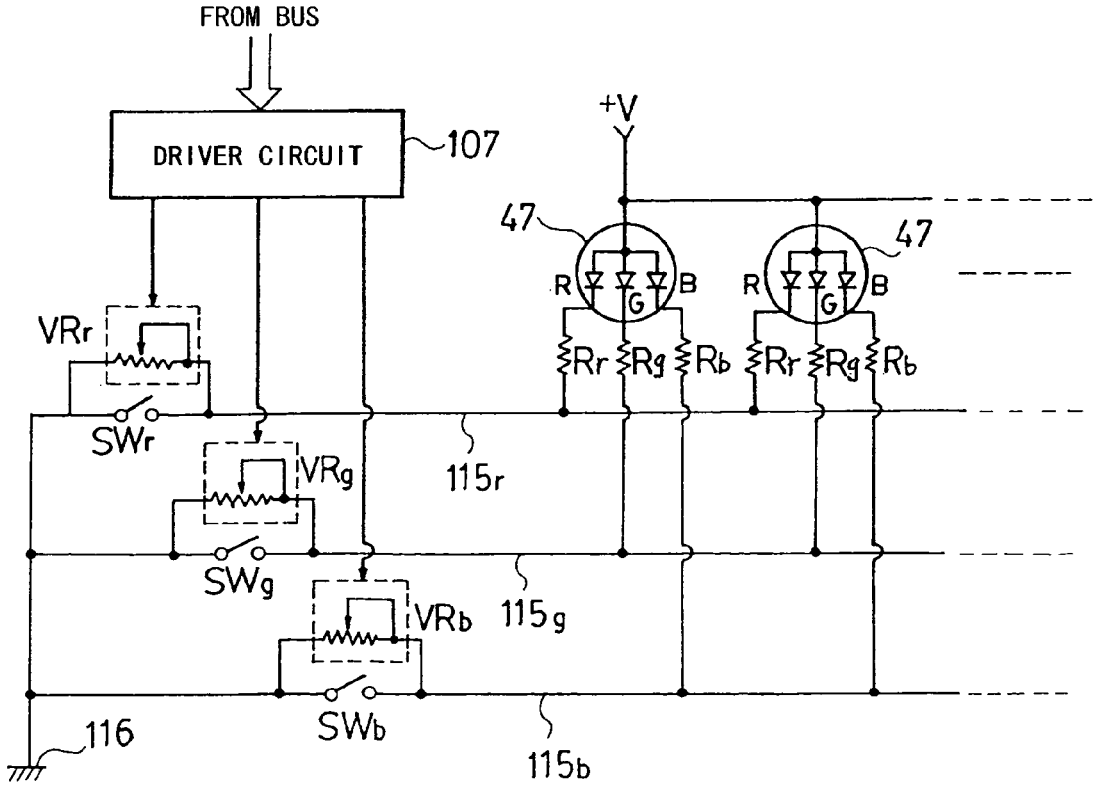
FIG. 11 is a circuit diagram showing one example of a peripheral circuit that is provided between a multicolored LED 47 in FIG. 10 and a driver circuit 107 in order to control lighting of each light emitting element of the multicolored LED 47.

Here, the peripheral circuit that is provided between the multicolored LED 47 and the diver circuit 107 in order to control lighting of the light emitting elements of the multicolored LED 47 will be described with reference to FIG. 11 and FIG. 12.

In this example, each of the plural multicolored LEDs 47 includes three light emitting units R, G, B emitting lights in red (R), green (G), and blue (B) respectively, which are disposed adjacent to one another. Anode sides of the light emitting elements R, G, B are commonly connected to a positive power source +V, and cathode sides thereof are connected to control lines 115*r*, 115*g*, 115*b* via protective resistors Rr, Rg, Rb of about 1 kΩ, respectively. Note that FIG. 11 only shows two multicolored LEDs 47, but actually a required number of them are connected in parallel.

A parallel circuit of a switch SWr and a variable resistor VRr is inserted between the control line 115*r* and a ground 116. A parallel circuit of a switch SWg and a variable resistor VRg is inserted between the control line 115*g* and the ground 116. A parallel circuit of a switch SWb and a variable resistor VRb is inserted between the control line 115*b* and the ground 116.

The switches SWr, SWg, SWb are switches opened/closed by a color selection operation element in the various operation unit 106, and resistance values of the variable resistors VRr, VRg, VRb are controlled by the driver circuit 107 based on a command sent from the CPU 101 via the bus 104.

The variable resistors VRr, VRg, VRb are large in their maximum resistance values (several hundred kΩ), with which almost no electric current passes therethrough. They have characteristics such that their resistance values, when controlled so as to reduce from the maximum resistance values, present a gradual linear decrease to 0 Ω.

According to this circuit, while the variable resistors VRr, VRg, VRb all have the maximum resistance values, it is possible to control the color of the emitted light of each of the multicolored LEDs 47 by the switches SWr, SWg, SWb. Specifically, only the light emitting element connected to the control line that is connected to an ON switch out of the switches SWr, SWg, SWb is lighted. Therefore, by separately lighting the light emitting elements R, G, B, it is possible to have each of the multicolored LEDs 47 emit light in one of red, green, and blue. Or, by lighting the light emitting units R and G, R and B, or G and B simultaneously, it is possible to have the multicolored LED 47 emit light in yellow, magenta, or cyan. It is also possible to light the light emitting elements R, G, B simultaneously to have the multicolored LED 47 emit light in white.

On the other hand, if the resistance values of the variable resistors VRr, VRg, VRb are controlled by the driver circuit 107 while all the switches SWr, SWg, SWb are kept OFF, a ratio of electric currents flowing through the light emitting elements R, G, B of the multicolored LED 47 can be arbitrarily controlled, so that control of the color of the emitted light of the multicolored LED 47 in various neutral colors is also possible in addition to control similar to the aforesaid control by the switches SWr, SWg, SWb.

Figure 12:
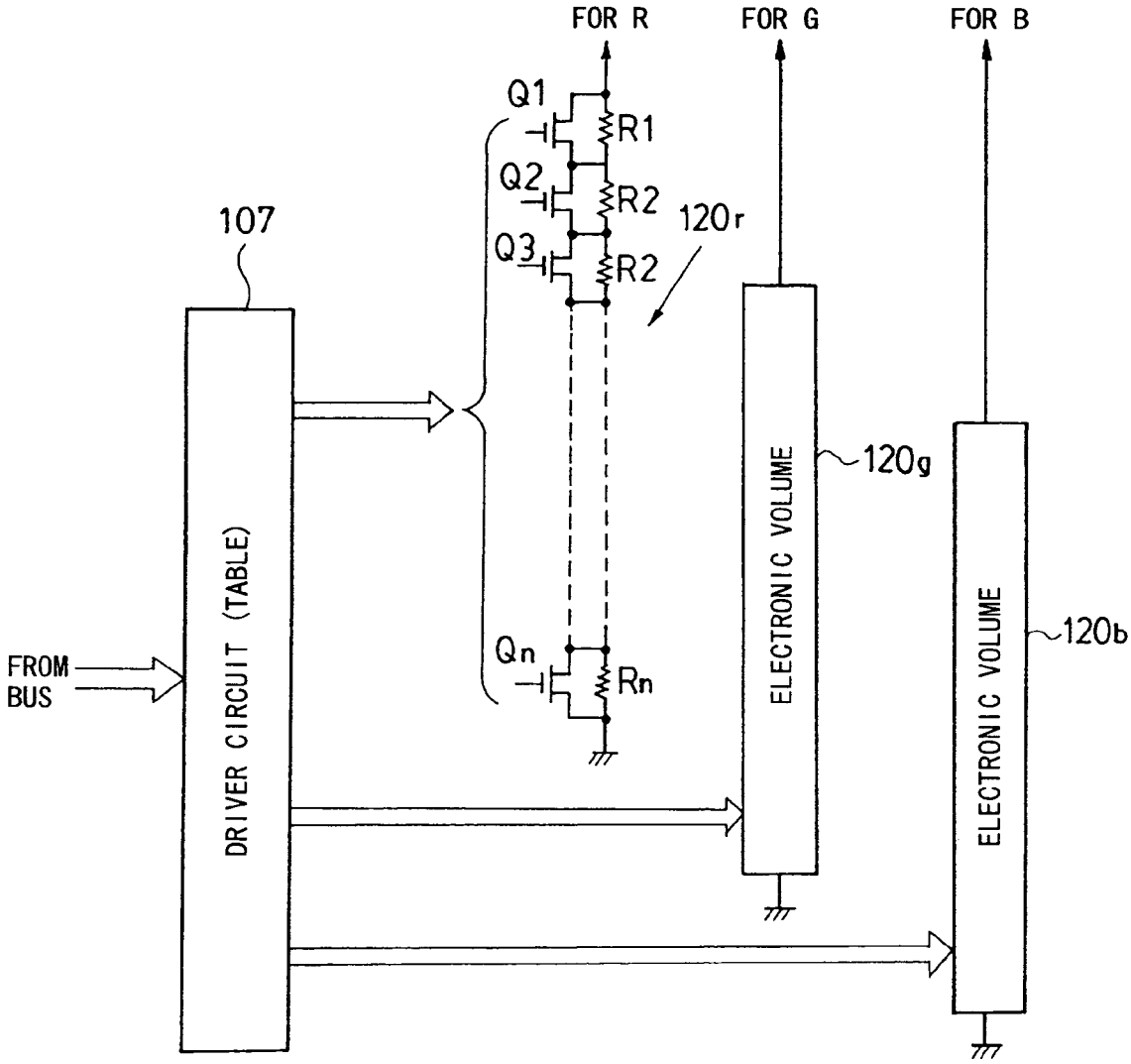
FIG. 12 is a circuit diagram showing another example of the aforesaid peripheral circuit.

FIG. 12 shows another example of such a peripheral circuit, and in this example, electric currents to be supplied to light emitting elements R, G, B of not-shown multicolored LEDs are controlled by three electronic volumes 120*r*, 120*g*, 120*b* whose resistance values are controlled by a driver circuit 107, thereby changing the color of emitted lights.

The electronic volumes 120*r*, 120*g*, 120*b* all have the same structure, and therefore, only the electronic volume 120*r* will be shown by a concrete circuit, and the other electronic volumes 102*g*, 120*b* are shown by blocks.

In this electronic volume, many resistors R1 to Rn are connected in series to a control line, and switching elements (FET) Q1 to Qn are individually connected thereto in parallel so as to allow individual short-circuit of the respective resistors R1 to Rn. When all the switching elements Q1 to Qn are OFF, the resistance value is high, so that almost no electric current is supplied to the light emitting element, resulting in no light emission. When the switching elements Q1 to Qn are turned on in sequence, the resistance value gets lower stepwise in accordance with the number of the switching elements that are turned on, and when all the switching elements are tuned on, the resistance value becomes zero, so that the maximum electric current is supplied to the light emitting element, resulting in light emission with the maximum light intensity.

The use of such a circuit also makes it possible to control the color of the emitted light of each of the multicolored LEDs in arbitrary color.

Eighth Embodiment

Figure 13:
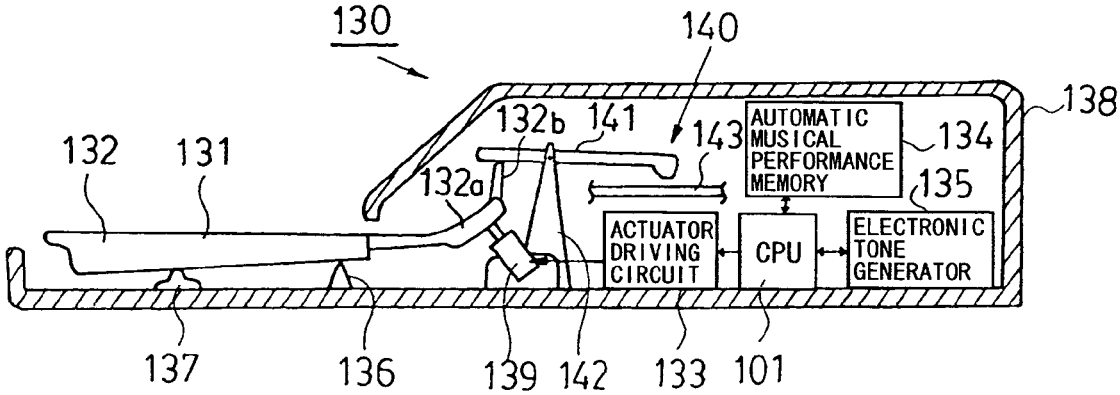
FIG. 13 is a simplified block diagram showing an eighth embodiment of the musical performance apparatus according to the invention.

Next, an example of a musical performance apparatus having a musical operation unit and an automatic musical performance function will be briefly described as an eighth embodiment of the musical performance apparatus according to the invention with reference to FIG. 13. FIG. 13 is a block diagram showing the musical performance apparatus in a simplified manner.

This musical performance apparatus 130 has an exposed keyboard as a musical operation unit 131 provided in front of a case 138 forming its exterior. The keyboard as the musical operation unit 131 has a plurality of keys 132 pivotally supported by fulcrum members 136, and from rear end portions of the keys 132, operation levers 132*a* having projection portions 132*b* extend.

Further, hammer levers 141 pivotally supported by fulcrum members 142 and a sound producing unit 140 (only part thereof is shown) including acoustic sounding bodies 143 such as strings or metal pieces are provided inside the case 138.

Therefore, a player's key pressing operation of the key 132 of the musical operation unit 131 causes the operation lever 132*a* to pivot together with the key 132, and its projection portion 132*b* causes the hammer lever 141 to pivot, so that the hammer lever 141 strikes the sounding body 143, which then produces sound. In this manner, the player can freely play the musical performance apparatus.

Further, since the musical performance apparatus 130 has the automatic musical performance function, many actuators 139 are provided for the respective operation levers 132*a* of the respective keys 132, and further, a CPU 101 (corresponding to the CPU 101 in FIG. 10), an actuator driving circuit 133, an automatic musical performance memory 134, and an electronic tone generator 135 are also provided.

Therefore, in the automatic musical performance, the CPU 101 reads automatic musical performance data from the automatic musical performance memory 134, and under the control of the CPU 101, the actuator driving circuit 133 drives a required actuator 139 according to key driving data in the automatic musical performance data, so that the operation lever 131*a* is pivoted to strike the sounding body 143, which then produces sound. The musical performance at this time is acoustic automatic musical performance similar to the musical performance by the player pressing the keys 32 of the musical operation unit 131.

Moreover, it is also possible that the electronic tone generator 135 generates a musical tone signal based on the automatic musical performance data read by the CPU 101 from the automatic musical performance memory 134 or based on a key code signal which is generated when the key switch 137 turns on in response to the pressing of the key 132 of the musical operation unit 131, thereby causing a not-shown sound system to produce musical sound. In short, manual musical performance and automatic musical performance with electronic sound are both possible.

In this musical performance apparatus 130, it is also possible to change colors of outer faces of the case 138 forming the exterior if the case 138 has the structure in any one of the foregoing embodiments. In particular, if the case 138 at least partly includes a light emitting unit whose light source is the multicolored LED similar to that in the fourth embodiment, it is possible to automatically discolor the color of at least part of the case 138 according to the mode of musical performance, during the musical performance by the operation of the musical operation unit 131 or during the automatic musical performance. The discoloration control is performed by the CPU 101 as follows.

Description of Processes by Flowchart

Next, processes executed mainly by the CPU of the electronic circuit shown in FIG. 10 will be described, using the flowcharts in FIG. 14 to FIG. 17, the timing chart in FIG. 18, and the chord table in FIG. 19.

Figure 14:
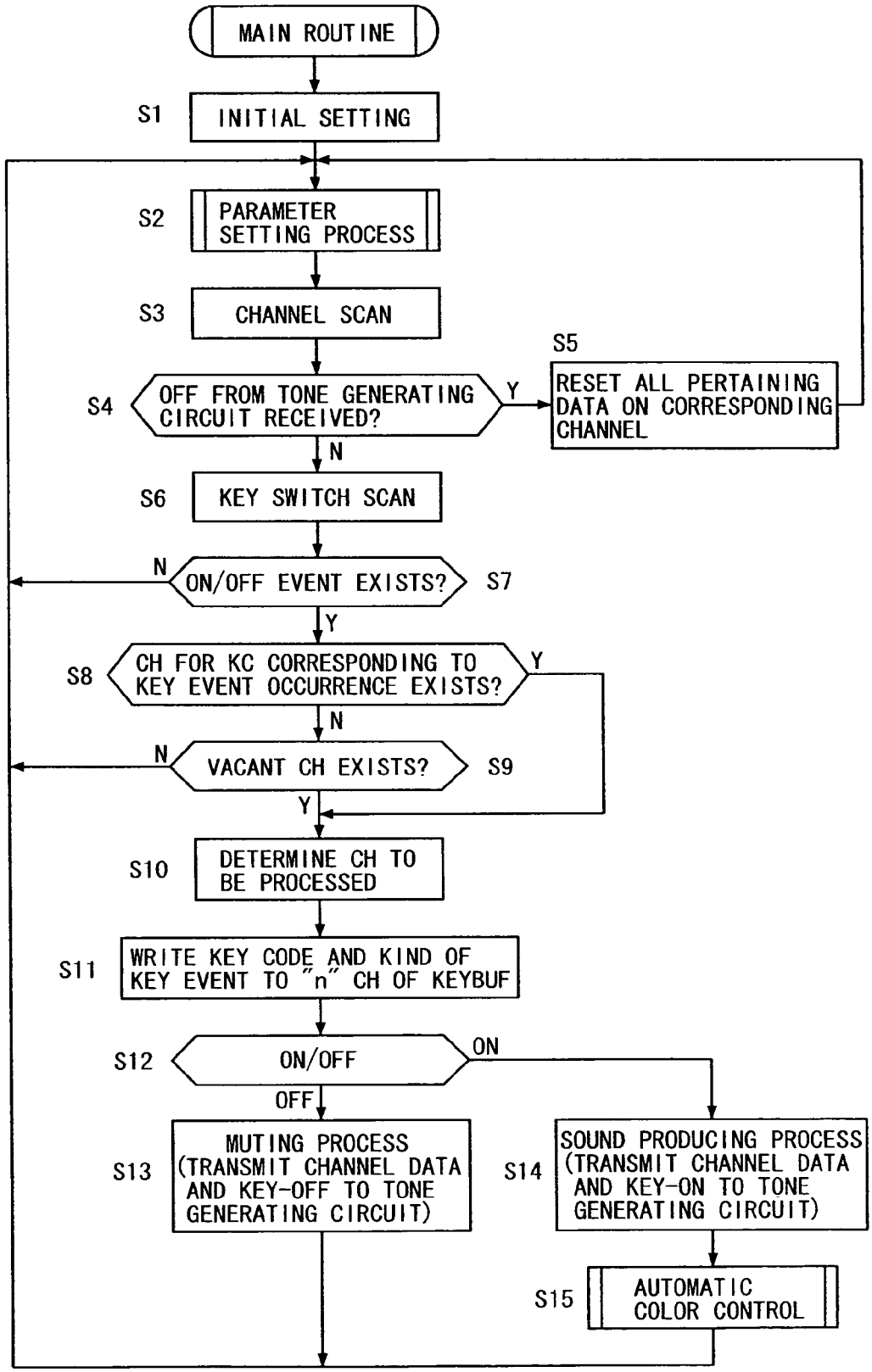
FIG. 14 is a flowchart showing main routine processes mainly performed by a CPU of the electronic circuit shown in FIG. 10
Figure 15:
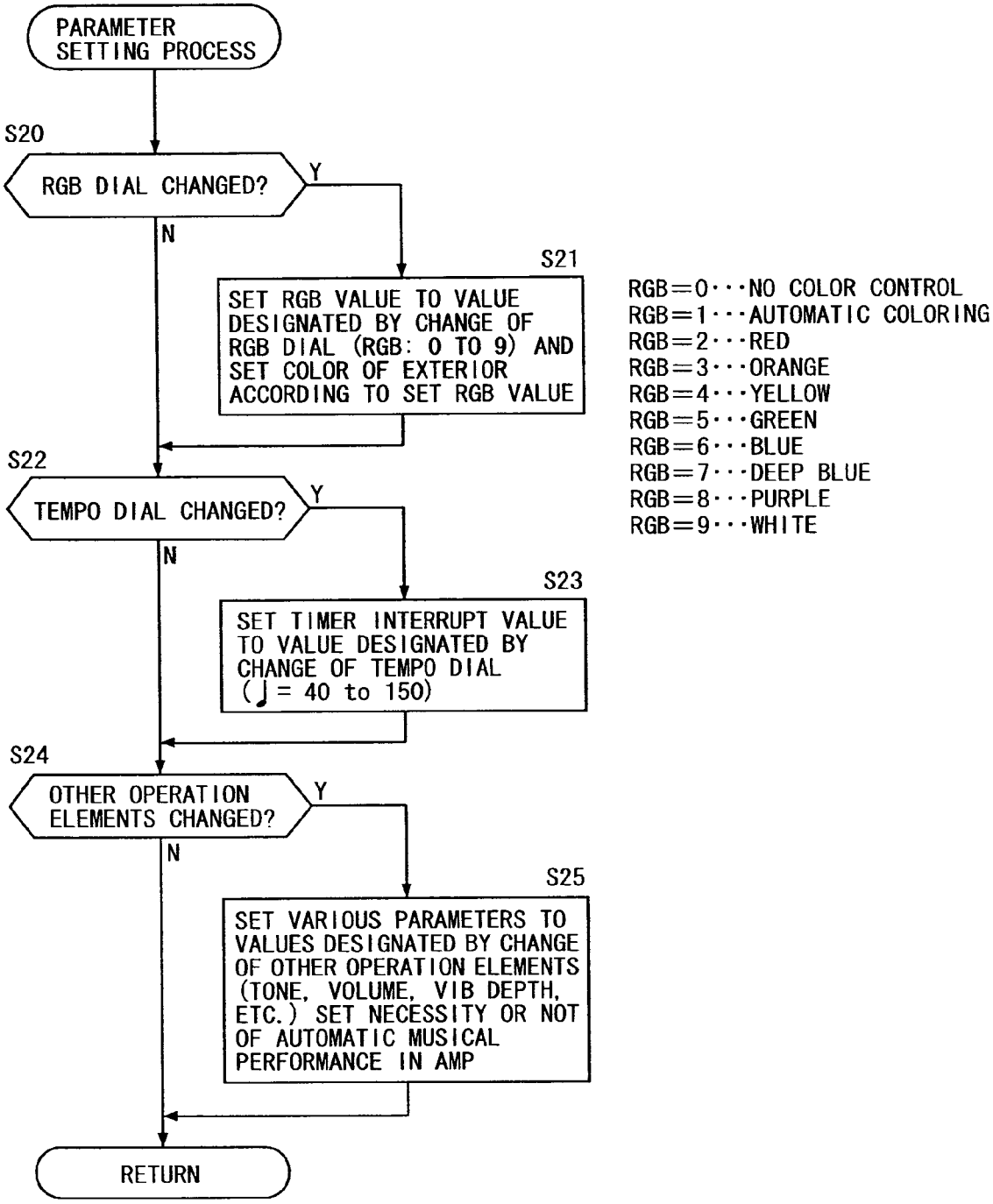
FIG. 15 is a flowchart showing a subroutine of a parameter setting process in FIG. 14.
Figure 16:
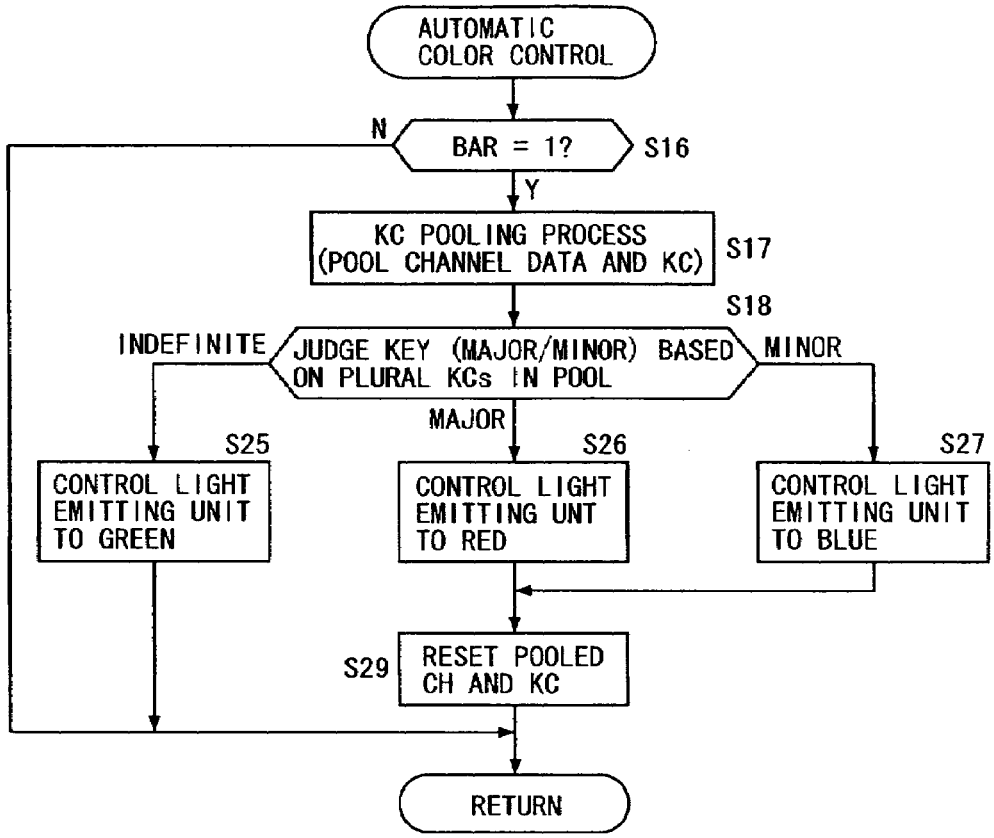
FIG. 16 is a flowchart showing a subroutine of an automatic color control process at Step 15 in FIG. 14 and FIG. 17.
Figure 17:
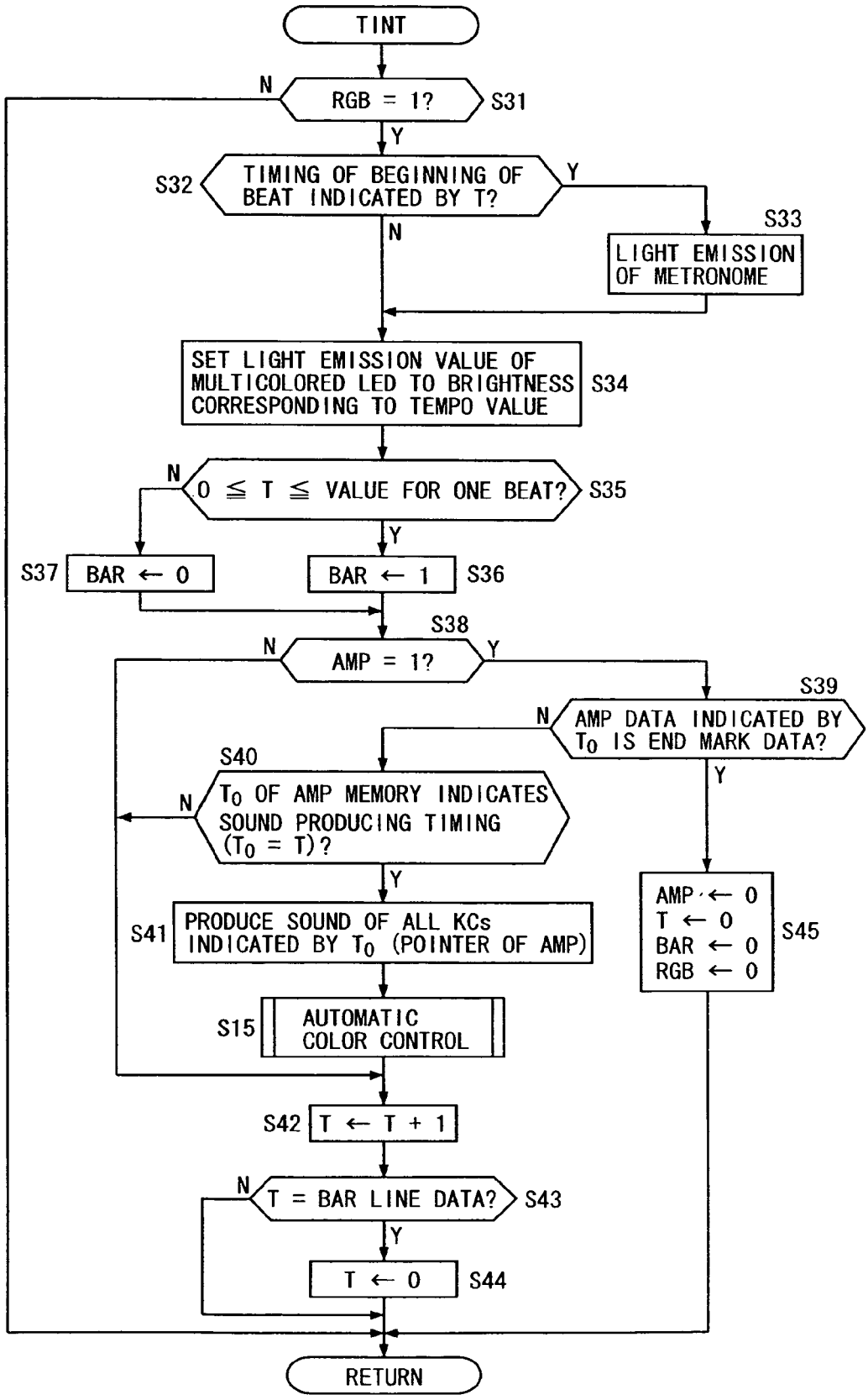
FIG. 17 is a flowchart showing timer interrupt processes based on a tempo pulse.

FIG. 14 is a flowchart showing processes of a main routine, FIG. 15 is a flowchart showing details of a subroutine of a parameter setting process at Step 2 in FIG. 14, FIG. 16 is a flowchart of a subroutine of an automatic color control process (Step 15) in FIG. 14, and FIG. 17 is a flowchart showing timer interrupt (TINT) processes based on a temp pulse. In the drawing Step is abbreviated to "S".

When the processes of the main routine shown in FIG. 14 is started, flags and registers are first set to basic states by initial setting upon power-on or the like at Step 1. For example, a flag AMP for automatic musical performance and a flag BAR for the beginning of a bar are set to 0 (zero). Channel buffer registers CH and other related registers are also initialized.

Next, at Step 2, the parameter setting process is executed. The details of the subroutine of the parameter setting process are shown in FIG. 15.

In this process, it is first judged at Step 20 whether or not an RGB dial is changed. The RGB dial is an operation element for designating the color of the exterior, and is shown as the RGB dial 67 in the fifth embodiment shown in FIG. 7. It is assumed that a similar RGB dial is provided in each of the other embodiments. The color of the exterior can be arbitrarily determined by rotating the RGB dial 67.

Here, for judging the change of the RGB dial, a stored RGB value previously set and an RGB value currently designated by the RGB dial are compared, and the change is judged based on whether or not there is any difference between these RGB values. Then, if there is a change, the flow goes to Step 22 after going through a process at Step 21, and if not, the flow goes directly to Step 22.

In this example, 0 to 9 are assigned as the RGB value. 0 designates no color control (the exterior is not to be colored and thus all the multicolored LEDs are lighted out), and 1 designates automatic coloring (the color of the exterior is to be automatically changed based on the musical sound control parameter or the like). 2 to 9 are for manual designation of color, 2 for red, 3 for orange, 4 for yellow, 5 for green, 6 for blue, 7 for deep blue, 8 for purple, and 9 for white.

At Step 21, the RGB value is set to a value designated by the change of the RGB dial (re-storage), and the color of the exterior is set according to this RGB value. However, when the set RGB value is 0, the coloring of the exterior is not executed, and thus all the multicolored LEDs 47 are left unlighted. If the set RGB value is 1, automatic coloring is executed, and thus the color of the exterior can be changed by a later-described process in the course of the musical performance. When the set RGB value is any of 2 to 9, the color of the emitted light of the multicolored LED is controlled so that the outer face of the exterior comes to have color appearance in the aforesaid corresponding color.

It is also possible to designate base color and thereafter designate automatic coloring by setting the RGB value to 1. In this case, with the color of the exterior being normally kept in the base color, the color temporarily changes to red when later-described key judgment results in major while the color temporarily changes to blue when this judgment results in minor, but when the judgment results in indefinite, it is possible to maintain the base color (for example, green).

At this time, it is preferable to display on the LCD 65 the set RGB value, or alternatively concrete color name, "no color control", or "automatic coloring".

Further, the set RGB value may be stored in a register CLR, and may be cleared after the musical performance is finished so that the RGB value returns to the original value (default value).

In this example, 0 to 9 are assigned as the RGB value, but also possible is a structure such that 256 kinds of RGB values are settable. This enables more diversified selection for the color of the exterior.

Next, at Step 22, it is judged whether or not a tempo dial is changed. The tempo dial is an operation element for designating tempo as a basis of musical performance, and is shown as the tempo dial 66 in the fifth embodiment shown in FIG. 7. It is assumed that a similar tempo dial is also provided in each of the other embodiments. Alternatively, the tempo may be changeable by a pedal operation element, and in this case, a change of the pedal operation element is judged at Step 22. Alternatively, in a case of an electronic musical instrument having an expression pedal EP as shown by the broken line in FIG. 1, the expression pedal EP may be linked to tempo/volume. In this case, since an original function of the expression pedal EP is volume control, the volume is set at Step 25 to be described later and tempo is also set at Step 23, according to the change of the expression pedal EP.

Here, for judging the change of the tempo dial, a timer interrupt value corresponding to the tempo currently designated by the tempo dial is compared with a stored timer interrupt value that is set according to the tempo previously designated by the tempo dial, and the judgment is made based on whether or not there is any difference between these timer interrupt values. The range of the tempo that can be designated is 40 clocks to 150 clocks for one quarter note (one beat). The timer interrupt value indicates a time interval at which the timer interrupt processes shown in FIG. 17 is executed.

Therefore, if it is judged at Step 22 that the tempo dial is changed, the flow goes to Step 24 after going through a process at Step 23, and if there is no change, the flow goes directly to Step 24. At Step 23, the timer interrupt value is set according to the value designated by the change of the tempo dial. At this time, the tempo after the change is preferably displayed on the LCD 65. Note that according to the tempo designated by the tempo dial, brightness of the exterior can be controlled in real time by controlling a light emission value of the multicolored LED in a later-described timer interrupt process.

At Step 24, it is judged whether or not there is any change in other operation elements, and if there is a change, various parameters that are changed are set at Step 25, and if not, the processes of this subroutine are finished, and the flow returns to the main routine in FIG. 14.

Here, the other operation elements are various operation elements for designating tone, volume, depth of vibrato (VIB), and so on provided on the operation panel and so on, and at Step 25, these values after the change are set (re-storage). At Step 24, a change in an operation element for setting automatic musical performance is also judged, and at Step 25, it is possible to set the automatic musical performance flag AMP to either "1: to execute automatic musical performance" or "0: not to execute automatic musical performance" according to whether or not setting of the automatic musical performance is designated. These set contents are also preferably displayed on the LCD 65.

Since the aforesaid RGB dial, tempo dial, and other operation elements are operable even while the musical instrument is being played, the processes of this subroutine are repeated in the course of the processes of the main routine in FIG. 14.

Note that in the processes of this main routine, processes regarding normal musical performance are executed at Step 3 to Step 14. The automatic color control process for automatically changing the color of the exterior under the progress of music based on the musical performance data is executed in the subroutine of Step 15. Here, the processes regarding the normal musical performance will be first described.

When the parameter setting process at Step 2 is finished, channels are scanned at Step 3. The channels here are sounding channels of sounds different in pitch designated by the key switches or the like of the keyboard, and if there are, for example, 16 channels, 16 kinds of sounds can be produced simultaneously.

Then, at Step 4, it is judged for each channel whether or not OFF (key-OFF) is received from the tone generating circuit 108, and if YES, pertaining data of the corresponding channel are all reset at Step 5, and the flow returns to Step 2.

If no OFF is received from the tone generating circuit 108 at Step 4, the flow goes to Step 6, where the key switches are scanned. Here, in a case of an electronic keyboard instrument, the key switches for all the keys (normally 88 keys) of the keyboard are scanned. In a case of other electronic musical instruments, operation elements (including switches and sensors) for designating pitch are scanned. Then, at Step 7, it is judged whether or not an ON/OFF event (key pressing/key release in a case of a keyboard) exists, and if NO, the flow returns to Step 2, while, if YES, it is judged at Step 8 whether or not a channel (CH) assigned to a key code (KC) corresponding to the key event occurrence exists.

If the channel assigned to the key code corresponding to the key event occurrence exists (when a key that is producing sound is turned off), this channel is determined at Step 10 as a channel to be processed, while, if not, it is judged at Step 9 whether or not any vacant channel exists. If YES, one of the vacant channels is determined at Step 10 as the channel to be processed. If there is no vacant channel, the flow returns to Step 2.

When the channel to be processed is determined at Step 10, the key code corresponding to the key event and the kind of the key event (ON/OFF) are written to an "n" channel (determined channel) of a register KEYBUF at Step 11.

Next, at Step 12, it is judged whether the kind of the key event is ON or OFF, and if OFF, a muting process of transmitting channel data and key-OFF (together with the key code) to the tone generating circuit 108 is executed at Step 13, and musical sound at the pitch corresponding to the key-OFF event is quickly reduced in volume. Then, the flow returns to Step 2. When the sound is attenuated to the level close to zero, the tone generating circuit 108 generates an OFF signal, followed by all reset at Step 5.

If the kind of the key event is ON, a sound producing process of transmitting the channel data and the key-ON (together with the key code) to the tone generating circuit 108 is executed at Step 14, and musical sound at the pitch corresponding to the key-ON is produced.

If the automatic coloring is not set, or if the current instant is not the timing for color control even though it is set, nothing is executed in the automatic color control process at Step 15, and the flow returns to Step 2.

By repeating the above-described processes, normal musical performance by the key operation and the like is executed. At this time, if the RGB value is set to one of 2 to 9 in the parameter setting process at Step 2, the multicolored LED 47 is caused to emit light in the corresponding color so that the exterior comes to have color appearance in that color. Real-time color change of the exterior by operating the RGB dial is possible even in the course of the musical performance.

Here, before describing the automatic color control process at Step 15 in this main routine, the timer interrupt (TINT) process in FIG. 17 will be described also referring to the timing chart in FIG. 18.

The TINT process in FIG. 17 is executed as an interruption that takes place in response to a tempo clock that is generated every timer interrupt value corresponding to the tempo set at Step 23 in FIG. 15, and after this process is executed, the flow returns to the main routine in FIG. 14.

It is first judged at Step 31 whether or not the flag RGB=1 is set (whether or not the automatic coloring is set). If the set value is not 1, this indicates that the automatic coloring is not set, and therefore nothing is executed, and the flow returns to the main routine in FIG. 14.

IF RGB=1, this indicates that the automatic coloring is set, and therefore, the flow goes to Step 32, where it is judged whether or not a value T of a tempo counter indicates the timing of the beginning of a beat. If it indicates the timing of the beginning of a beat, a metronome is caused to emit light at Step 33. For example, the LED 65M shown in FIG. 7 is caused to emit flashing light.

The timing of the beginning of a beat is an instant at which the first tempo clock of a beat is inputted. As will be described later, the tempo counter counts up every time the TINT process is executed, and resets the value when the count value reaches a value corresponding to a bar line.

Figure 18:
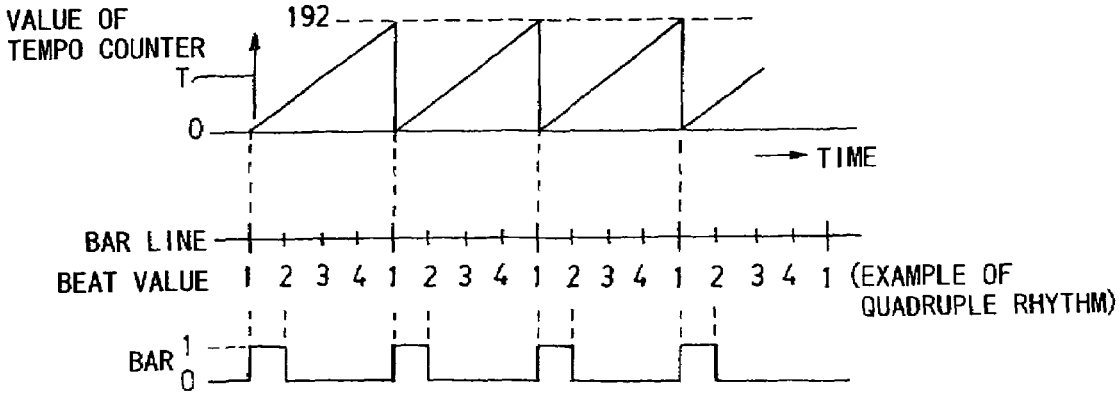
FIG. 18 is a timing chart to explain the relation between a counter value of a tempo counter T and a flag BAR in the timer interrupt processes in FIG. 17.

FIG. 18 shows the relation between the count value T of the tempo counter, bar lines, a beat value in a case of a quadruple rhythm, and a value of the flag BAR. For example, when 48 tempo clocks for one beat is set as the tempo, one bar corresponds to 192 tempo clocks since there are four beats in one bar, and therefore, the tempo counter resets the count value when counting up to 192 from 0. An instant at which the counter value T of the tempo counter is "0", "48", "96", and "144" at the beginning of the first, second, third, and fourth beats is the timing of the beginning of a beat. Therefore, the metronome emits light at the first timing of each beat.

Thereafter, the flow goes to Step 34, where the light emission value of the multicolored LED 47 is set to brightness corresponding to the set tempo value. By this process, lightness, that is, brightness, of color appearance of the outer face of the exterior can be controlled in real time according to the change in tempo when tempo is changed by the tempo dial, the pedal operation element, or the like in the course of the musical performance. This function corresponds to the brightness controller. At Step 34, the brightness change may be controlled based on data, which is stored in a header in the automatic musical performance memory, regarding designated points (for example, the beginnings of the first and twelfth bars) in a designated musical piece, and based on the tempo value that is set thereafter.

Here, the color of the exterior may also be controlled by changing a light emission ratio of the light emitting elements for the respective colors of the multicolored LED 47 according to the set tempo value. Alternatively, the color of the exterior may be similarly controlled by an arbitrary musical sound control parameter such as volume, tone, or depth of vibrato that is set by the parameter setting process.

Next, at Step 35, it is judged whether or not the value T of the tempo counter is 0≦T≦value for one beat (48 in the aforesaid example), that is, whether or not the value T is within a period of the first beat in one bar, and if YES, the flag BAR for the beginning of a bar is set to "1" at Step 36, and if NO, the flag BAR is set to "0" at Step 37. Therefore, as shown in the lower part in FIG. 18, the value of the flag BAR is "1" only within the period of the first beat of each bar, and is "0" in other periods.

Thereafter, it is judged at Step 38 whether or not the value of the automatic musical performance flag AMP is "1". If NO, this indicates that the automatic musical performance is not set, and therefore, the flow goes directly to Step 42, where the value T of the tempo counter is set to T+1 (counting up). Then, at Step 43, it is judged whether or not the value T is data indicating a bar line ("192" in the aforesaid example), and if NO, the flow returns directly to the process at the time of the occurrence of the interruption. If the value T is the data indicating a bar line, the value T of the tempo counter is reset to "0", and the flow returns.

If AMP=1 at Step 38, this indicates that the automatic musical performance is set, and therefore, the flow goes to Step 39, where it is judged whether or not the AMP data (automatic musical performance data) indicated by a value of a pointer $T_0$ of a read automatic musical performance memory is end mark data. If it is the end mark data, this means that the automatic musical performance is finished, and therefore, the automatic musical performance flag AMP, the value T of the tempo counter, the flag BAR for the beginning of a bar, and the color designation value RGB are all reset to "0" at Step 45, and thereafter, the flow returns to the process at the time when the interruption takes place.

At this time, the register CLR is cleared in this process at Step 45 to return the color designation value RGB to the original value instead of setting it to "0", if the selected RGB value is stored in the register CLR in the aforesaid process at Step 21 in FIG. 15. This enables the outer faces of the exterior to have color appearance in default color.

If the AMP data is judged at Step 39 not to be the end mark data, the flow goes to Step 40, where it is judged whether or not the value of the aforesaid pointer $T_0$ indicates a sound producing timing ($T_0$=T), and if NO, the flow goes directly to Step 42, where the tempo counter counts up. On the other hand, if it indicates the sound producing timing, all the key codes (KC) indicated by the pointer of the AMP are read at Step 41 to produce their sounds.

This enables automatic musical performance without using the musical operation unit such as a keyboard. Then, in the automatic color control process at Step 15, it is judged whether or not the musical piece being automatically played is in major or in minor, and the colors of the emitted lights of the light emitting elements are controlled based on the judgment result, thereby changing the color of the exterior. This process is executed in the subroutine shown in FIG. 16. This process is the same as that in a case of manual musical performance in a main routine to be described next.

Here, returning to the description of the main routine in FIG. 14, the subroutine of the automatic color control process at Step 15 subsequent to the sound producing process at Step 14 will be described.

In this process, it is first judged at Step 16 whether or not the value of the flag BAR is "1", as shown in FIG. 16. If the automatic coloring has not been set, the flag BAR has the value "0" as initially set at S1. In this example, even if the automatic coloring has been set, the flag BAR has "0" in the periods except the period within the first beat of the beginning of a bar in the aforesaid TINT process in FIG. 17, and therefore, nothing is executed and the flow returns to the main routine in FIG. 14 and returns to the parameter setting process at Step 2.

If the flag BAR is set to "1", the flow goes to Step 17 and subsequent steps, where processes of automatically changing the color of the exterior are executed. Therefore, a key code (KC) pooling process is executed at Step 17. That is, the channel data and key codes (KC) written at Step 11 are sequentially pooled in a pool register.

Then, at Step 18, it is judged based on the pooled plural key codes (KC) whether or not the key being a parameter showing the motif of a musical piece that is being played is major or minor, and the color of the emitted light of the light emitting unit (multicolored LED) 47 is controlled according the judgment result. A key judging method for this control will be described later.

If the judgment result is "major", the flow goes to Step 26, where the light emitting unit is controlled to emit red light, and if the judgment result is "minor", the flow goes to Step 27, where the light emitting unit is controlled to emit blue light. Thereafter, in either case, the pooled channel (CH) and the key codes (KC) are reset at Step 29 and the flow returns to the main routine.

If the judgment result at Step 18 is "indefinite", the flow goes to Step 28, where the light emitting unit is controlled to emit green light which corresponds neither to major nor to minor, and the flow goes to a sound producing process at Step 16. In this case, the pooled channel (CH) and key codes (KC) are not reset, but when the next key event takes place, a new channel (CH) and key code (KC) are further pooled at Step 17, and the key judgment is made again at Step 18 based on the plural pooled key codes.

When the key cannot be judged, the control may be such that the color set according to the result of the previous key judgment is maintained. In this case, the color is also initially set to green only at the first time.

In this example, the key codes (including melody sound and accompaniment sound) inputted at the first beat of each bar are sequentially pooled at Step 16, and in the key judgment process at Step 17, pitch differences (interval) are sequentially calculated for the first inputted key code and the key codes inputted second and thereafter, and after three notes or more are pooled, the notes are arranged in the ascending order of the pitch, they are compared with the table shown in FIG. 19 for key judgment. If the judgment cannot be made, the first note is octave-inverted and the comparison is made again. A seventh (7th) chord is judged either as major or as minor.

After three notes are pooled, the judgment is started, and if the judgment cannot be made, the judgment is restarted when the next note (key code) is pooled.

As this key judging method, usable is a method described in, for example, JP 2663938 B, in detail.

The chord table in FIG. 19 has a column for the number K, a column for chord type CT (K), a column for chord pattern CPTN (K) that is compared with candidate constituent notes of a chord detected based on key operations and the like (in this example, based on the pooled key codes), and thus used as a detection rule, and a column for reference pattern (key classification).

Here, a pitch difference (interval) pattern in which the key codes of the three notes or more pooled in the aforesaid manner are arranged in the ascending order of the pitch is compared with the chord patterns CPTN (K) in FIG. 19, and if the pattern matches any of the chord patterns CPTN (K), the corresponding reference pattern is determined as the key judgment result.

This judgment only causes the color change of the exterior and even if inaccurate, does not influence the musical performance, and thus is not very significantly problematic.

Incidentally, the processes in the case of the automatic musical performance described with reference to FIG. 17 correspond to the processes in the example described with reference to FIG. 13 in the case where based on the automatic musical performance data (AMP data) read from the automatic musical performance memory 134, the CPU 101 directly causes the electronic tone generator (corresponding to the tone generating circuit 108 shown in FIG. 10) to generate the musical tone signal for producing the musical sound.

At this time, since no key event takes place, the main routine in FIG. 14 is only repetition of the procedure from Step 2 to Step 7 after always returning from Step 2 to Step 7. However, manual musical performance by the operation of the musical operation unit such as the keyboard can be in parallel with this automatic musical performance.

For example, melody can be manually played while accompaniment is automatically played. In this case, the color of the exterior can be also changed according to the mode of the musical performance.

However, another possible method is such that the CPU 101 extracts key driving data from the automatic musical performance data read from the automatic musical performance memory 134 to have the actuators 139 or the like drive the keys of the musical operation unit, thereby causing automatic musical performance.

In this case, sound is not actually produced in the sound producing process at Step 15 in the TINT process in FIG. 17, but all the key codes (KC) indicated by the pointer $T_0$ are read from the automatic musical performance memory, and the actuators 139 are driven based on the driving data of the keys corresponding to the read key codes (KC) to press the keys.

In this case, the sound producing process and the automatic color control process are executed in the main routine in FIG. 14 in the same manner as in the case of the manual musical performance. Therefore, the automatic color control process at Step 15 is not necessary after Step 41, so that the subroutine of Step 15 is not required.

This makes the invention applicable also to an automatic musical performance apparatus such as a music box that performs automatic musical performance by the operation of sounding bodies based on automatic musical performance data.

Modification Example of Embodiment

In the foregoing description, the key of a musical piece is judged based on the plural key codes that are generated within the period of the first beat (if it is a quarter note, its length) of each bar of the sound of musical performance. However, it is also possible to judge motif such as major or minor based on key codes within other predetermined beat, within the plural beats, or within the first beat or plural beats of the beginning of a phrase (one bar or the plural bars), or based on key codes in one bar unit or in the plural bar units. Further, musical performance data other than the key codes may be used to generate various other musical sound control parameters, thereby controlling the color of the emitted light of the light emitting unit (multicolored LED) based on these musical sound control parameters.

Further, as another method of automatically judging the tempo of a played musical piece, the number of key codes (corresponding to the number of notes) occurring in a beat unit, a bar unit, a phrase unit, or the like may be counted, which enables the judgment of the tempo as a musical sound control parameter based on the counted numerical value. It is possible to automatically control the color of the emitted light of the light emitting unit according to the judgment result.

Moreover, it is also possible to detect a musical sound control parameter such as an average pitch value or an average volume value in a beat unit, a bar unit, a phrase unit, or the like to control the color of the emitted light of the light emitting unit according such a musical sound control parameter.

It is suitable for the fourth to eighth embodiments described above to generate these musical sound control parameters and control the color of the exterior of the musical performance apparatus according to these musical sound control parameters. However, this control is also applicable to the first embodiment in such a manner that, instead of controlling the color of the emitted light of the light emitting unit according to the musical control parameters, the temperature of the outer faces of the exterior 2 is controlled by controlling lighting/lighting-out or the light intensity of the lights 34, or by change control of the radiation position.

Further, this control is also applicable to the second embodiment if the temperature of the outer faces of the exterior 2 is controlled by varying a supply amount, a length of supply time, or the like of electrical current to the heater wires 5 according to the musical sound control parameter. Similarly, this control is also applicable to the third embodiment if the temperature of the outer faces of the exterior 2 is controlled by varying the polarity and an amount of the electric current supplied to the Peltier modules 7. A color change reaction spontaneously takes place with about 0.5 second delay or as a gentle change, which can offer entertainment as lighting art full of variety.

INDUSTRIAL APPLICABILITY

The invention is applicable not only to the electronic keyboard instrument, the electronic trumpet, and the electronic cellos shown in the foregoing embodiments, but is of course applicable to other various kinds of electronic musical instruments such as an electronic stringed instrument, an electronic brass instrument, an electronic woodwind instrument, and an electronic percussion. In addition, it is also applicable to acoustic keyboard instruments, stringed instruments, brass instruments, woodwind instruments, percussions, and so on, and also applicable to wide variety of musical performance apparatuses such as various kinds of automatic musical performance apparatuses including a music box.

It is possible to change the color of the exterior according to a change in environmental temperature, to easily change the color of the exterior so as to suite a user's taste, intended use, and so on, and to automatically change the color of the outer faces of the musical performance apparatus itself according to the kind or contents of a played musical piece or according to the mode of the musical performance. This can attract more interest of a player and those appreciating the musical performance and make the musical performance more entertaining.

What is claimed is:

1. A musical performance apparatus comprising:

a musical operation unit;

an exterior forming, by an outer face thereof, an outer shape of the unique musical performance apparatus;

a musical sound control parameter generator generating a musical sound control parameter; and a parameter responding discoloration controller controlling color of the temperature sensitive discolorable layer in response to the musical sound control parameter generated by said musical sound control parameter generator, wherein part or a whole of the outer face of said exterior is formed as a temperature sensitive discolorable layer.

2. A musical performance apparatus according to claim 1, wherein the musical sound control parameter is motif, and said parameter responding discoloration controller controls change of the color of the temperature sensitive discolorable layer according to the motif.

3. A musical performance apparatus according to claim 1, wherein the musical sound control parameter is tempo, and said parameter responding discoloration controller controls change of the color of the temperature sensitive discolorable layer according to the tempo.

4. A musical performance apparatus according to claim 1, wherein said musical sound control parameter generator generates the musical sound control parameter based on automatic musical performance data.

5. A musical performance apparatus according to claim 1, wherein said musical sound control parameter generator generates the musical sound control parameter according to progress of music of musical performance.

6. A musical performance apparatus according to claim 1, wherein said musical sound control parameter generator generates the musical sound control parameter based on beat data or bar unit data of sound of musical performance.

7. A musical performance apparatus according to claim 1, wherein said parameter responding discoloration controller performs the control operation only at a predetermined beat of sound of musical performance.

8. A musical performance apparatus according to claim 1, wherein said musical sound control parameter generator generates, as the musical sound control parameter, data indicating whether a played musical piece is in major or in minor, and wherein said parameter responding discoloration controller controls the color of the temperature sensitive discolorable layer in response to the data indicating whether the played musical piece is in major or in minor, which is generated by said musical sound control parameter generator.

9. A musical performance apparatus according to claim 8, wherein said parameter responding discoloration controller performs the control operation only at a beginning of a phrase of sound of musical performance.

10. A musical performance apparatus comprising:

a musical operation unit; and an exterior forming, by an outer face thereof, an outer shape of the unique musical performance apparatus, wherein part or a whole of the outer face of said exterior is formed as a coloration layer, and the musical performance apparatus further comprising:

a multicolored light emitting unit that is provided on an inner side of the coloration layer to emit light to the coloration layer, said multicolored light emitting unit includes a plurality of light emitting elements, each of which emit light in a different color from one another; and a controller that controls color of the light emitted by said multicolored light emitting unit by adjusting the intensity of light emission of each of the plurality of light emitting elements to thereby set color of the part or the whole of the outer face of said exterior to one color or a plurality of colors among the colors of the emitted light.

11. A musical performance apparatus comprising:

a musical operation unit; and an exterior forming, by an outer face thereof, an outer shape of the unique musical performance apparatus, wherein part or a whole of the outer face of said exterior is formed as a coloration layer, and the musical performance apparatus further comprising:

a multicolored light emitting unit that is provided on an inner side of the coloration layer to emit light to the coloration layer, and a controller that controls color of the light emitted by said multicolored light emitting unit to thereby set color of the part or the whole of the outer face of said exterior to one color or a plurality of colors among the colors of the emitted light wherein said controller has a brightness controller controlling brightness of the color of the part or the whole of the outer face of the exterior according to tempo of sound of musical performance.

12. A musical performance apparatus comprising:

a musical operation unit;

an exterior forming, by an outer face thereof, an outer shape of the unique musical performance apparatus; and a musical sound control parameter generator generating a musical sound control parameter, wherein part or a whole of the outer face of said exterior is formed as a coloration layer, the musical performance apparatus further comprising:

a multicolored light emitting unit that is provided on an inner side of the coloration layer to emit light to the coloration layer, a controller that controls color of the light emitted by said multicolored light emitting unit to thereby set color of the part or the whole of the outer face of said exterior to one color or a plurality of colors among the colors of the emitted light, and wherein said controller is a parameter responding discoloration controller that controls the color of the part or the whole of the outer face of the exterior in response to the musical sound control parameter generated by said musical sound control parameter generator.

13. A musical performance apparatus according to claim 12, wherein the musical sound control parameter is motif, and said parameter responding discoloration controller controls change of the color of the part or the whole of the outer face of the exterior according to the motif.

14. A musical performance apparatus according to claim 12, wherein the musical sound control parameter is tempo, and said parameter responding discoloration controller controls change of the color of the part or the whole of the outer face of the exterior according to the tempo.

15. A musical performance apparatus according to claim 12, wherein said musical sound control parameter generator generates the musical sound control parameter based on automatic musical performance data.

16. A musical performance apparatus according to claim 12, wherein said musical sound control parameter generator generates the musical sound control parameter according to progress of music of musical performance.

17. A musical performance apparatus according to claim 12, wherein said musical sound control parameter generator generates the musical sound control parameter based on beat data or bar unit data of sound of musical performance.

18. A musical performance apparatus according to claim 12, wherein said parameter responding discoloration controller performs the control operation only at a predetermined beat of sound of musical performance.

19. A musical performance apparatus according to claim 12, wherein said musical sound control parameter generator generates, as the musical sound control parameter, data indicating whether a played musical piece is in major or in minor, and wherein said parameter responding discoloration controller controls the color of the part or the whole of the outer face of the exterior in response to the data indicating whether the played musical piece is in major or in minor, which is generated by said musical sound control parameter generator.

20. A musical performance apparatus according to claim 19, wherein said parameter responding discoloration controller performs the control operation only at a beginning of a phrase of sound of musical performance.

21. A musical performance apparatus comprising:

a musical operation unit;

a body;

an exterior frame extended from the body and forming at least a part of an outline of the musical performance apparatus, wherein, the longitudinal front face of said exterior frame includes a rough surface that is formed of a light guide as a coloration member, wherein the light emitting unit is provided on an end surface of the body side of the frame, and wherein, a light emitted from the light emitting unit enters from the end surface to a center of the exterior frame, said light being progressively diffused by said rough surface of the exterior frame so as to be emitted outward through the longitudinal front face of the exterior frame.

* * * * *